US011571886B2

(12) United States Patent
Sumi

(10) Patent No.: US 11,571,886 B2
(45) Date of Patent: Feb. 7, 2023

(54) CONTROL APPARATUS FOR PRINTING APPARATUS, PRINTING METHOD, AND STORAGE MEDIUM

(71) Applicant: CANON KABUSHIKI KAISHA, Tokyo (JP)

(72) Inventor: Naoki Sumi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 39 days.

(21) Appl. No.: 17/180,892

(22) Filed: Feb. 22, 2021

(65) Prior Publication Data

US 2021/0170744 A1 Jun. 10, 2021

Related U.S. Application Data

(60) Division of application No. 16/351,702, filed on Mar. 13, 2019, now Pat. No. 10,953,651, which is a continuation of application No. 15/602,414, filed on May 23, 2017, now Pat. No. 10,265,947.

(30) Foreign Application Priority Data

May 31, 2016 (JP) ..... 2016-109392

(51) Int. Cl.

| | |
|---|---|
| ***B41J 2/045*** | (2006.01) |
| ***B41J 2/205*** | (2006.01) |
| ***B41J 19/14*** | (2006.01) |
| ***B41J 11/00*** | (2006.01) |
| ***B41J 2/21*** | (2006.01) |

(52) U.S. Cl.
CPC ..... *B41J 2/04536* (2013.01); *B41J 2/04581* (2013.01); *B41J 2/2054* (2013.01); *B41J 2/2103* (2013.01); *B41J 11/0035* (2013.01); *B41J 19/142* (2013.01)

(58) Field of Classification Search
CPC .. B41J 2/04536; B41J 2/04581; B41J 2/2054; B41J 2/2103; B41J 11/0035; B41J 19/142
See application file for complete search history.

(56) References Cited

U.S. PATENT DOCUMENTS

| | | | |
|---|---|---|---|
| 7,463,384 | B2 | 12/2008 | Tsuchiya et al. |
| 9,195,917 | B2 | 11/2015 | Nakagawa et al. |
| 2001/0017085 | A1 | 8/2001 | Kubo et al. |

(Continued)

FOREIGN PATENT DOCUMENTS

| | | | |
|---|---|---|---|
| JP | H09-193368 | A | 7/1997 |
| JP | 2004-174817 | A | 6/2004 |
| JP | 2007-118440 | A | 5/2007 |

(Continued)

OTHER PUBLICATIONS

IP.com search (Year: 2022).*

(Continued)

*Primary Examiner* — Lisa Solomon
(74) *Attorney, Agent, or Firm* — Venable LLP

(57) ABSTRACT

A printing apparatus prints an image by applying ink to a print surface of an inclined print medium using a print head. A control apparatus for the printing apparatus acquires information on an inclination of the print surface. Based on the information, printing is controlled according to a print condition corresponding to a magnitude of the inclination of the print surface.

17 Claims, 11 Drawing Sheets

(56) References Cited

U.S. PATENT DOCUMENTS

| | | | |
|---|---|---|---|
| 2013/0286126 | A1 | 10/2013 | Hoepner et al. |
| 2014/0139885 | A1 | 5/2014 | Nakagawa et al. |

FOREIGN PATENT DOCUMENTS

| | | | | |
|---|---|---|---|---|
| JP | 2008-126505 | A | | 6/2008 |
| JP | 2009-179028 | A | | 8/2009 |
| JP | 2011-125835 | A | | 6/2011 |
| JP | 2011125835 | A | * | 6/2011 |
| JP | 2014-050964 | A | | 3/2014 |
| JP | 2014-113819 | A | | 6/2014 |
| JP | 2015-047582 | A | | 3/2015 |
| JP | 2015-150771 | A | | 8/2015 |

OTHER PUBLICATIONS

Feb. 18, 2020 Japanese Official Action in Japanese Patent Appln. No. 2017-102878.
IP.com Search (2020).
Machine Translation, JP 2015-150771, "Printer Controller and Print Control Method," Matsumoto, Daisuke, et al., Aug. 24, 2015, Paragraphs 0003, 0007-0009, 0016-0021, 0029-0060.
Jan. 4, 2022 Japanese Official Action in Japanese Patent Appln. No. 2021-000332.
Office Action in Japanese Patent Application No. 2021-000332, dated Jul. 19, 2022.

* cited by examiner 615 (613)

614 (612)

603

| | | | | | | | | | | | | | | | | | | | | | | | | | |
|---|---|---|---|---|---|---|---|---|---|---|---|---|---|---|---|---|---|---|---|---|---|---|---|---|---|
| 0 | 0 | 0 | 0 | 0 | 0 | 1.4 | 1.4 | 1.4 | 1.4 | 1.4 | 1.4 | 1.4 | 1.4 | 1.4 | 1.4 | 1.4 | 1.4 | 1 | 1 | 1 | 1 | 1 | 1 | 1 | 1 | 1 |
| 0 | 0 | 0 | 0 | 0 | 0 | 1.4 | 1.4 | 1.4 | 1.4 | 1.4 | 1.4 | 1.4 | 1.4 | 1.4 | 1.4 | 1.4 | 1.4 | 1 | 1 | 1 | 1 | 1 | 1 | 1 | 1 | 1 |
| 0 | 0 | 0 | 0 | 0 | 0 | 1.4 | 1.4 | 1.4 | 1.4 | 1.4 | 1.4 | 1.4 | 1.4 | 1.4 | 1.4 | 1.4 | 1.3 | 1 | 1 | 1 | 1 | 1 | 1 | 1 | 1 | 1 |
| 0 | 0 | 0 | 0 | 0 | 0 | 1.4 | 1.4 | 1.4 | 1.4 | 1.4 | 1.4 | 1.4 | 1.4 | 1.4 | 1.4 | 1.4 | 1.2 | 1 | 1 | 1 | 1 | 1 | 1 | 1 | 1 | 1 |
| 0 | 0 | 0 | 0 | 0 | 0 | 1.4 | 1.4 | 1.4 | 1.4 | 1.4 | 1.4 | 1.4 | 1.4 | 1.4 | 1.4 | 1.4 | 1 | 1 | 1 | 1 | 1 | 1 | 1 | 1 | 1 | 1 |
| 0 | 0 | 0 | 0 | 0 | 0 | 1.4 | 1.4 | 1.4 | 1.4 | 1.4 | 1.4 | 1.4 | 1.4 | 1.4 | 1.4 | 1.4 | 1 | 1 | 1 | 1 | 1 | 1 | 1 | 1 | 1 | 1 |
| 0 | 0 | 0 | 0 | 0 | 1.4 | 1.4 | 1.4 | 1.4 | 1.4 | 1.4 | 1.4 | 1.4 | 1.4 | 1.4 | 1.4 | 1.4 | 1 | 1 | 1 | 1 | 1 | 1 | 1 | 1 | 1 | 1 |
| 0 | 0 | 0 | 0 | 0 | 1.4 | 1.4 | 1.4 | 1.4 | 1.4 | 1.4 | 1.4 | 1.4 | 1.4 | 1.4 | 1.4 | 1.3 | 1 | 1 | 1 | 1 | 1 | 1 | 1 | 1 | 1 | 1 |
| 0 | 0 | 0 | 0 | 0 | 1.4 | 1.4 | 1.4 | 1.4 | 1.4 | 1.4 | 1.4 | 1.4 | 1.4 | 1.4 | 1.4 | 1.2 | 1 | 1 | 1 | 1 | 1 | 1 | 1 | 1 | 1 | 1 |
| 0 | 0 | 0 | 0 | 0 | 1.4 | 1.4 | 1.4 | 1.4 | 1.4 | 1.4 | 1.4 | 1.4 | 1.4 | 1.4 | 1.4 | 1.2 | 1 | 1 | 1 | 1 | 1 | 1 | 1 | 1 | 1 | 1 |
| 0 | 0 | 0 | 0 | 0 | 1.4 | 1.4 | 1.4 | 1.4 | 1.4 | 1.4 | 1.4 | 1.4 | 1.4 | 1.4 | 1.4 | 1.2 | 1 | 1 | 1 | 1 | 1 | 1 | 1 | 1 | 1 | 1 |
| 0 | 0 | 0 | 0 | 0 | 1.4 | 1.4 | 1.4 | 1.4 | 1.4 | 1.4 | 1.4 | 1.4 | 1.4 | 1.4 | 1.4 | 1.2 | 1 | 1 | 1 | 1 | 1 | 1 | 1 | 1 | 1 | 1 |
| 0 | 0 | 0 | 0 | 0 | 1.4 | 1.4 | 1.4 | 1.4 | 1.4 | 1.4 | 1.4 | 1.4 | 1.4 | 1.4 | 1.4 | 1.2 | 1 | 1 | 1 | 1 | 1 | 1 | 1 | 1 | 1 | 1 |
| 0 | 0 | 0 | 0 | 0 | 1.4 | 1.4 | 1.4 | 1.4 | 1.4 | 1.4 | 1.4 | 1.4 | 1.4 | 1.4 | 1.4 | 1.2 | 1 | 1 | 1 | 1 | 1 | 1 | 1 | 1 | 1 | 1 |
| 0 | 0 | 0 | 0 | 0 | 1.4 | 1.4 | 1.4 | 1.4 | 1.4 | 1.4 | 1.4 | 1.4 | 1.4 | 1.4 | 1.4 | 1.2 | 1 | 1 | 1 | 1 | 1 | 1 | 1 | 1 | 1 | 1 |
| 0 | 0 | 0 | 0 | 0 | 1.4 | 1.4 | 1.4 | 1.4 | 1.4 | 1.4 | 1.4 | 1.4 | 1.4 | 1.4 | 1.4 | 1.2 | 1 | 1 | 1 | 1 | 1 | 1 | 1 | 1 | 1 | 1 |
| 0 | 0 | 0 | 0 | 0 | 1.4 | 1.4 | 1.4 | 1.4 | 1.4 | 1.4 | 1.4 | 1.4 | 1.4 | 1.4 | 1.4 | 1.2 | 1 | 1 | 1 | 1 | 1 | 1 | 1 | 1 | 1 | 1 |
| 0 | 0 | 0 | 0 | 0 | 1.4 | 1.4 | 1.4 | 1.4 | 1.4 | 1.4 | 1.4 | 1.4 | 1.4 | 1.4 | 1.4 | 1.2 | 1 | 1 | 1 | 1 | 1 | 1 | 1 | 1 | 1 | 1 |
| 0 | 0 | 0 | 0 | 0 | 1.4 | 1.4 | 1.4 | 1.4 | 1.4 | 1.4 | 1.4 | 1.4 | 1.4 | 1.4 | 1.4 | 1.2 | 1 | 1 | 1 | 1 | 1 | 1 | 1 | 1 | 1 | 1 |
| 0 | 0 | 0 | 0 | 0 | 14 | 14 | 14 | 14 | 14 | 14 | 14 | 14 | 14 | 14 | 14 | 12 | 1 | 1 | 1 | 1 | 1 | 1 | 1 | 1 | 1 | 1 |
| 0 | 0 | 0 | 0 | 0 | 1.4 | 1.4 | 1.4 | 1.4 | 1.4 | 1.4 | 1.4 | 1.4 | 1.4 | 1.4 | 1.4 | 1.2 | 1 | 1 | 1 | 1 | 1 | 1 | 1 | 1 | 1 | 1 |
| 0 | 0 | 0 | 0 | 0 | 1.4 | 1.4 | 1.4 | 1.4 | 1.4 | 1.4 | 1.4 | 1.4 | 1.4 | 1.4 | 1.4 | 1.3 | 1 | 1 | 1 | 1 | 1 | 1 | 1 | 1 | 1 | 1 |
| 0 | 0 | 0 | 0 | 0 | 1.4 | 1.4 | 1.4 | 1.4 | 1.4 | 1.4 | 1.4 | 1.4 | 1.4 | 1.4 | 1.4 | 1.4 | 1 | 1 | 1 | 1 | 1 | 1 | 1 | 1 | 1 | 1 |
| 0 | 0 | 0 | 0 | 0 | 0 | 1.4 | 1.4 | 1.4 | 1.4 | 1.4 | 1.4 | 1.4 | 1.4 | 1.4 | 1.4 | 1.4 | 1 | 1 | 1 | 1 | 1 | 1 | 1 | 1 | 1 | 1 |
| 0 | 0 | 0 | 0 | 0 | 0 | 1.4 | 1.4 | 1.4 | 1.4 | 1.4 | 1.4 | 1.4 | 1.4 | 1.4 | 1.4 | 1.4 | 1 | 1 | 1 | 1 | 1 | 1 | 1 | 1 | 1 | 1 |
| 0 | 0 | 0 | 0 | 0 | 0 | 1.4 | 1.4 | 1.4 | 1.4 | 1.4 | 1.4 | 1.4 | 1.4 | 1.4 | 1.4 | 1.4 | 1.2 | 1 | 1 | 1 | 1 | 1 | 1 | 1 | 1 | 1 |
| 0 | 0 | 0 | 0 | 0 | 0 | 1.4 | 1.4 | 1.4 | 1.4 | 1.4 | 1.4 | 1.4 | 1.4 | 1.4 | 1.4 | 1.4 | 1.3 | 1 | 1 | 1 | 1 | 1 | 1 | 1 | 1 | 1 |
| 0 | 0 | 0 | 0 | 0 | 0 | 1.4 | 1.4 | 1.4 | 1.4 | 1.4 | 1.4 | 1.4 | 1.4 | 1.4 | 1.4 | 1.4 | 1.4 | 1 | 1 | 1 | 1 | 1 | 1 | 1 | 1 | 1 |
| 0 | 0 | 0 | 0 | 0 | 0 | 1.4 | 1.4 | 1.4 | 1.4 | 1.4 | 1.4 | 1.4 | 1.4 | 1.4 | 1.4 | 1.4 | 1 | 1 | 1 | 1 | 1 | 1 | 1 | 1 | 1 | 1 |

610

608 (410)

607 (416)

609 (606)

FIG.5

615 (613)

614 (612)

603

| | | | | | | | | | | | | | | | | | | | | | | | | | | |
|---|---|---|---|---|---|---|---|---|---|---|---|---|---|---|---|---|---|---|---|---|---|---|---|---|---|---|
| 255 | 255 | 255 | 255 | 255 | 255 | 0 | 0 | 0 | 0 | 0 | 0 | 0 | 0 | 0 | 0 | 0 | 0 | 75 | 75 | 75 | 75 | 75 | 75 | 75 | 75 | 75 |
| 255 | 255 | 255 | 255 | 255 | 255 | 0 | 0 | 0 | 0 | 0 | 0 | 0 | 0 | 0 | 0 | 0 | 7 | 75 | 75 | 75 | 75 | 75 | 75 | 75 | 75 | 75 |
| 255 | 255 | 255 | 255 | 255 | 255 | 0 | 0 | 0 | 0 | 0 | 0 | 0 | 0 | 0 | 0 | 0 | 22 | 75 | 75 | 75 | 75 | 75 | 75 | 75 | 75 | 75 |
| 255 | 255 | 255 | 255 | 255 | 255 | 0 | 0 | 0 | 0 | 0 | 0 | 0 | 0 | 0 | 0 | 0 | 37 | 75 | 75 | 75 | 75 | 75 | 75 | 75 | 75 | 75 |
| 255 | 255 | 255 | 255 | 255 | 255 | 0 | 0 | 0 | 0 | 0 | 0 | 0 | 0 | 0 | 0 | 0 | 67 | 75 | 75 | 75 | 75 | 75 | 75 | 75 | 75 | 75 |
| 255 | 255 | 255 | 255 | 255 | 255 | 0 | 0 | 0 | 0 | 0 | 0 | 0 | 0 | 0 | 0 | 0 | 75 | 75 | 75 | 75 | 75 | 75 | 75 | 75 | 75 | 75 |
| 255 | 255 | 255 | 255 | 255 | 0 | 0 | 0 | 0 | 0 | 0 | 0 | 0 | 0 | 0 | 0 | 7 | 75 | 75 | 75 | 75 | 75 | 75 | 75 | 75 | 75 | 75 |
| 255 | 255 | 255 | 255 | 255 | 0 | 0 | 0 | 0 | 0 | 0 | 0 | 0 | 0 | 0 | 0 | 22 | 75 | 75 | 75 | 75 | 75 | 75 | 75 | 75 | 75 | 75 |
| 255 | 255 | 255 | 255 | 255 | 0 | 0 | 0 | 0 | 0 | 0 | 0 | 0 | 0 | 0 | 0 | 30 | 75 | 75 | 75 | 75 | 75 | 75 | 75 | 75 | 75 | 75 |
| 255 | 255 | 255 | 255 | 255 | 0 | 0 | 0 | 0 | 0 | 0 | 0 | 0 | 0 | 0 | 0 | 37 | 75 | 75 | 75 | 75 | 75 | 75 | 75 | 75 | 75 | 75 |
| 255 | 255 | 255 | 255 | 255 | 0 | 0 | 0 | 0 | 0 | 0 | 0 | 0 | 0 | 0 | 0 | 37 | 75 | 75 | 75 | 75 | 75 | 75 | 75 | 75 | 75 | 75 |
| 255 | 255 | 255 | 255 | 255 | 0 | 0 | 0 | 0 | 0 | 0 | 0 | 0 | 0 | 0 | 0 | 37 | 75 | 75 | 75 | 75 | 75 | 75 | 75 | 75 | 75 | 75 |
| 255 | 255 | 255 | 255 | 255 | 0 | 0 | 0 | 0 | 0 | 0 | 0 | 0 | 0 | 0 | 0 | 37 | 75 | 75 | 75 | 75 | 75 | 75 | 75 | 75 | 75 | 75 |
| 255 | 255 | 255 | 255 | 255 | 0 | 0 | 0 | 0 | 0 | 0 | 0 | 0 | 0 | 0 | 0 | 37 | 75 | 75 | 75 | 75 | 75 | 75 | 75 | 75 | 75 | 75 |
| 255 | 255 | 255 | 255 | 255 | 0 | 0 | 0 | 0 | 0 | 0 | 0 | 0 | 0 | 0 | 0 | 37 | 75 | 75 | 75 | 75 | 75 | 75 | 75 | 75 | 75 | 75 |
| 255 | 255 | 255 | 255 | 255 | 0 | 0 | 0 | 0 | 0 | 0 | 0 | 0 | 0 | 0 | 0 | 37 | 75 | 75 | 75 | 75 | 75 | 75 | 75 | 75 | 75 | 75 |
| 255 | 255 | 255 | 255 | 255 | 0 | 0 | 0 | 0 | 0 | 0 | 0 | 0 | 0 | 0 | 0 | 30 | 75 | 75 | 75 | 75 | 75 | 75 | 75 | 75 | 75 | 75 |
| 255 | 255 | 255 | 255 | 255 | 0 | 0 | 0 | 0 | 0 | 0 | 0 | 0 | 0 | 0 | 0 | 37 | 75 | 75 | 75 | 75 | 75 | 75 | 75 | 75 | 75 | 75 |
| 255 | 255 | 255 | 255 | 255 | 0 | 0 | 0 | 0 | 0 | 0 | 0 | 0 | 0 | 0 | 0 | 30 | 75 | 75 | 75 | 75 | 75 | 75 | 75 | 75 | 75 | 75 |
| 255 | 255 | 255 | 255 | 255 | 0 | 0 | 0 | 0 | 0 | 0 | 0 | 0 | 0 | 0 | 0 | 22 | 75 | 75 | 75 | 75 | 75 | 75 | 75 | 75 | 75 | 75 |
| 255 | 255 | 255 | 255 | 255 | 0 | 0 | 0 | 0 | 0 | 0 | 0 | 0 | 0 | 0 | 0 | 7 | 75 | 75 | 75 | 75 | 75 | 75 | 75 | 75 | 75 | 75 |
| 255 | 255 | 255 | 255 | 255 | 255 | 0 | 0 | 0 | 0 | 0 | 0 | 0 | 0 | 0 | 0 | 0 | 75 | 75 | 75 | 75 | 75 | 75 | 75 | 75 | 75 | 75 |
| 255 | 255 | 255 | 255 | 255 | 255 | 0 | 0 | 0 | 0 | 0 | 0 | 0 | 0 | 0 | 0 | 0 | 67 | 75 | 75 | 75 | 75 | 75 | 75 | 75 | 75 | 75 |
| 255 | 255 | 255 | 255 | 255 | 255 | 0 | 0 | 0 | 0 | 0 | 0 | 0 | 0 | 0 | 0 | 0 | 37 | 75 | 75 | 75 | 75 | 75 | 75 | 75 | 75 | 75 |
| 255 | 255 | 255 | 255 | 255 | 255 | 0 | 0 | 0 | 0 | 0 | 0 | 0 | 0 | 0 | 0 | 0 | 22 | 75 | 75 | 75 | 75 | 75 | 75 | 75 | 75 | 75 |
| 255 | 255 | 255 | 255 | 255 | 255 | 0 | 0 | 0 | 0 | 0 | 0 | 0 | 0 | 0 | 0 | 0 | 7 | 75 | 75 | 75 | 75 | 75 | 75 | 75 | 75 | 75 |
| 255 | 255 | 255 | 255 | 255 | 255 | 0 | 0 | 0 | 0 | 0 | 0 | 0 | 0 | 0 | 0 | 0 | 0 | 75 | 75 | 75 | 75 | 75 | 75 | 75 | 75 | 75 |

610

608 (410)

607 (416)

609 (606)

FIG.6

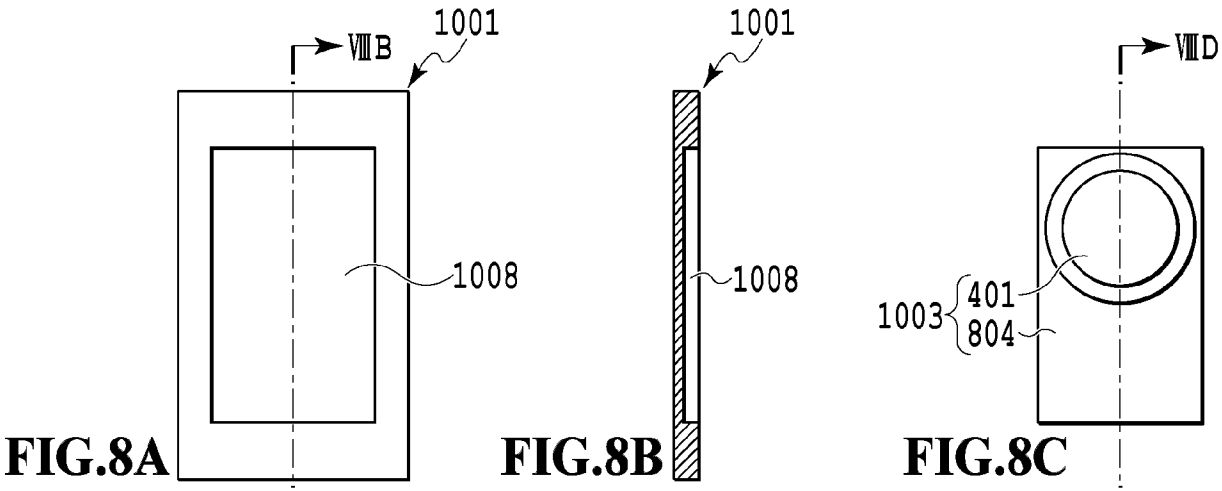
FIG.8A
FIG.8B
FIG.8C
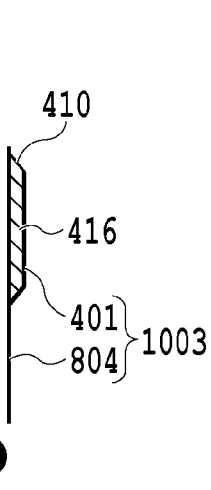
FIG.8D
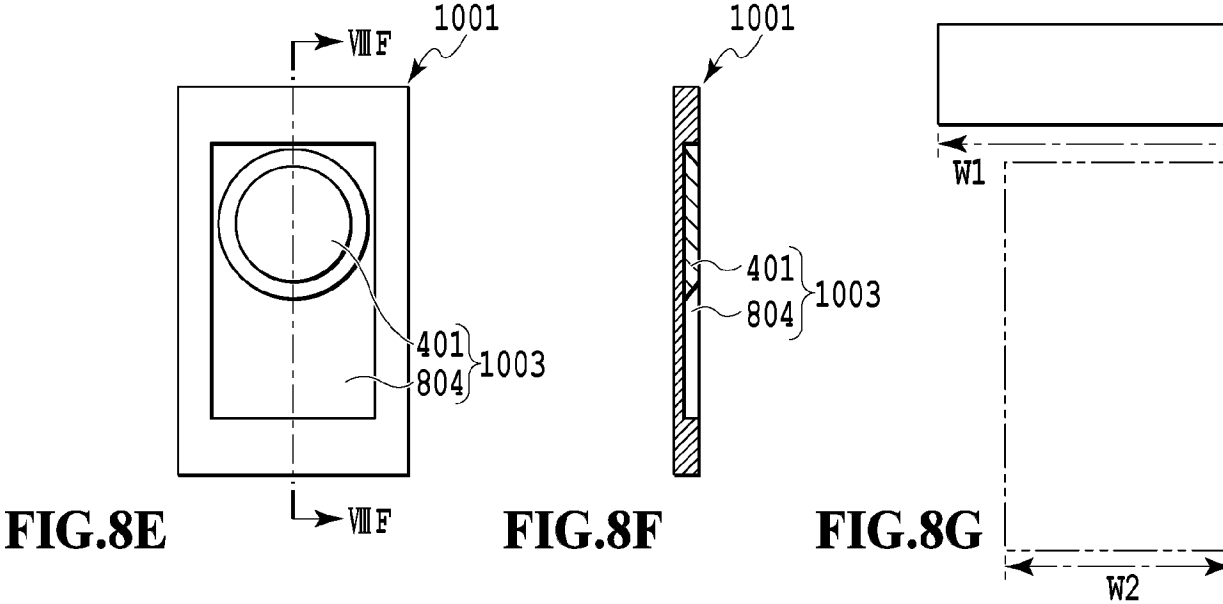
FIG.8E
FIG.8F
FIG.8G
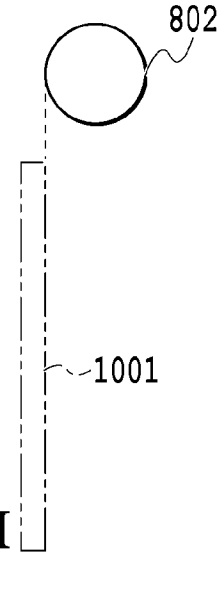
FIG.8H

CONTROL APPARATUS FOR PRINTING APPARATUS, PRINTING METHOD, AND STORAGE MEDIUM

This application is a division of U.S. patent application Ser. No. 16/351,702 filed Mar. 13, 2019, which is a continuation of U.S. patent application Ser. No. 15/602,414 filed May 23, 2017, U.S. Pat. No. 10,265,947 B2, which claims the benefit of Japanese Patent Application No. 2016-109392 filed May 31, 2016, which applications are hereby incorporated by reference herein in their entireties.

BACKGROUND OF THE INVENTION

Field of the Invention

The present invention relates to a control apparatus for a printing apparatus, a printing method, and a storage medium for printing an image on a print surface of a print medium with a locally varying inclination.

Description of the Related Art

Japanese Patent Laid-Open No. 2009-179028 describes an ink jet printing apparatus that prints an image on a print medium by deflecting an ejection direction of charged ink particles using a deflection electrode. The printing apparatus is configured to control a charge voltage at which the ink particles are charged by a charge electrode in order to print characters with an even height on a curved print medium.

The printing apparatus described in Japanese Patent Laid-Open No. 2009-179028 is a system that prints images using the charge electrode and the deflection electrode. For printing apparatuses not including such a charge electrode or a deflection electrode, however, in a case in which an image is printed on a print surface with a locally varying inclination, printing a uniform image is difficult due to the inclination.

SUMMARY OF THE INVENTION

The present invention provides a control apparatus for a printing apparatus, a printing method, and a storage medium for printing a more uniform image on a print medium with an inclined print surface.

In a first aspect, the present invention provides a control apparatus for a printing apparatus that prints an image by applying ink to a print surface using a print head, the control apparatus comprising an acquisition unit configured to acquire information on an inclination of the print surface of a print medium placed on a support surface that supports the print medium, the print medium having a locally varying thickness, the print surface being inclined to the support surface, and a control unit configured to control, based on the information acquired by the acquisition unit, printing according to a print condition corresponding to a magnitude of the inclination.

In a second aspect, the present invention provides a control apparatus for a printing apparatus that prints an image by applying ink to a print surface of a print medium using a print head, the control apparatus comprising an acquisition unit configured to acquire information on a height of the print medium placed on a support surface that supports the print medium, the print medium having a locally varying height from the support surface, and a control unit configured to control, based on the information acquired by the acquisition unit, printing according to a print condition corresponding to the height.

In a third aspect, the present invention provides a printing method for printing an image by applying ink to a print surface using a print head, the printing method comprising an acquisition step of acquiring information on an inclination of the print surface of a print medium placed on a support surface that supports the print medium, the print medium having a locally varying thickness, the print surface being inclined to the support surface, and a printing step of performing printing according to a print condition corresponding to a magnitude of the inclination.

In a fourth aspect, the present invention provides a printing method for printing an image by applying ink to a print surface of a print medium using a print head, the printing method comprising an acquisition step of acquiring information on a height of the print medium placed on a support surface that supports the print medium, the print medium having a locally varying height from the support surface, and a printing step of performing printing according to a print condition corresponding to the height.

In a fifth aspect, the present invention provides a storage medium in which a program code configured to execute the printing method according to the third aspect of the present invention.

According to the present invention, the ink application volume is controlled according to the magnitude of inclination of the print surface to minimize the adverse effect of inclination of the print surface, allowing a more uniform image on the inclined print surface.

Further features of the present invention will become apparent from the following description of exemplary embodiments (with reference to the attached drawings).

BRIEF DESCRIPTION OF THE DRAWINGS

FIG. 5 is a diagram illustrating information on the inclination of the print surface of the print medium.

FIG. 6 is a diagram illustrating signal values in which information on the inclination of the print surface is reflected.

FIG. 8A is a plan view of a tray used in the second embodiment of the present invention, FIG. 8B is a sectional view taken along line VIIIB-VIIIB in FIG. 8A, FIG. 8C is a plan view of a print medium, FIG. 8D is a sectional view taken along line VIIID-VIIID, FIG. 8E is a plan view of the tray with the print medium fitted therein, FIG. 8F is a sectional view taken along line VIIIF-VIIIF in FIG. 8E, FIG. 8G is a plan view of a pinch roller, and FIG. 8H is a side view of the pinch roller.

DESCRIPTION OF THE EMBODIMENTS

Embodiments of the present invention will be described below based on the drawings. First, before a description of the embodiments of the present invention, basic configurations of an information processing apparatus (control apparatus) and a printing apparatus will be described.

Basic Configuration of the Information Processing Apparatus

Figure 1:
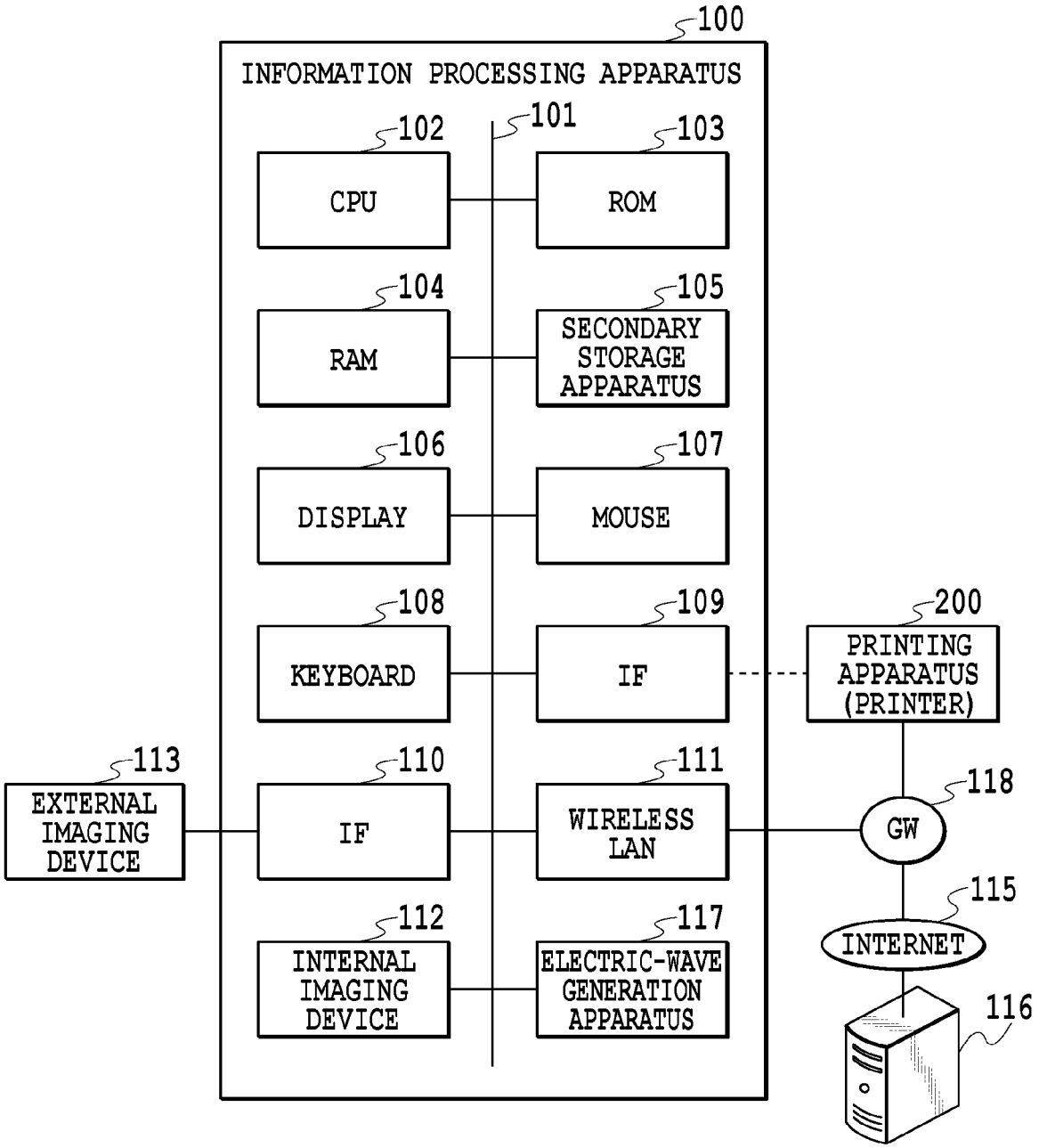
FIG. 1 is a diagram illustrating a basic configuration of an information processing apparatus serving as a control apparatus in the present invention.

FIG. 1 is a diagram illustrating an example of a basic configuration of an information processing apparatus (control apparatus) 100. A control bus/data bus 101 connects component units of the information processing apparatus 100 and a central processing unit (CPU) 102 together. The CPU 102 executes an information processing method in the present embodiment in accordance with a program. A read only memory (ROM) 103 stores the program executed by the CPU 102. A random access memory (RAM) 104 is used as a memory that temporarily stores various pieces of information in a case in which the CPU 102 executes the program. A secondary storage apparatus 105, including a hard disk, a flash memory stores image files, and the like, stores an image file, results of image analysis, and the like. A display 106 is a display apparatus configured to present the results of processing in the present embodiment to a user. The display 106 has a touch panel function such that operation of a touch panel enables processing instructions to be given and also allows input of characters and other operations to be performed. To the CPU 102, user interfaces (UI) can be connected, such as a mouse 107 that allows a user to input processing instructions, and the like, and a keyboard via which the user inputs characters, and the like.

The information processing apparatus 100 includes an internal imaging device 112. Images taken by the internal imaging device 112 are subjected to predetermined image processing such that the resultant images are stored in the secondary storage apparatus 105. Images can also be loaded through an external imaging device 113 connected to the CPU 102 via an interface (IF) 110. The information processing apparatus 100 includes a wireless local area network (LAN) 111 connected to an internet 115 via a gate way (GW) 118. The information processing apparatus 100 can receive and acquire images and data from an external server connected to the internet. The information processing apparatus 100 transmits various data and pieces of information to an external server 116 so that the external server 116 can store and process the data and information.

A printing apparatus (printer) 200 is connected via the GW 118 to an LAN, the internet, or both thereof to transmit data to, and to receive data from, the information processing apparatus 100 via the wireless LAN 111. The printing apparatus 200 can be connected to the information processing apparatus 100 in a wired manner via an IF 109. The IF 109 is, for example, a Universal Serial Bus (USB) or a wired LAN. An electrical-wave generation apparatus 117 performs data communication, and the like, by generating electrical waves based on power transmitted from the information processing apparatus 100. The electrical-wave generation apparatus 117 has, for example, a near field wireless communication (NFC) function, and a wireless communication function, such as Bluetooth® or infrared communication.

Examples of an apparatus into which the information processing apparatus 100 is integrated include mobile computer terminals, such as smartphones and tablet personal computers, and apparatuses with built-in electrical-wave generation apparatuses, such as digital cameras, video cameras, televisions, and speakers. In a case in which the information processing apparatus 100 is provided with an acceleration sensor (not depicted in the drawings), the information processing apparatus 100 can acquire acceleration information. Power needed for operation of the information processing apparatus 100 is supplied by a battery (not depicted in the drawings) provided in the information processing apparatus 100.

Configuration of the Printing Apparatus

Figure 2A:
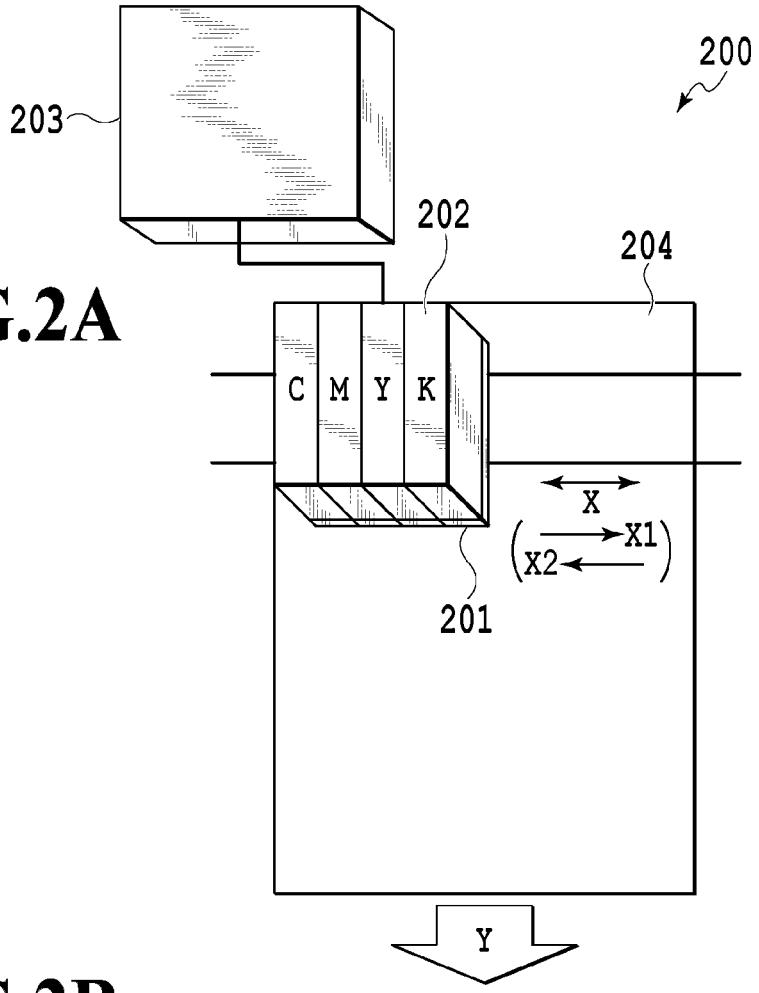
FIG. 2A is a diagram illustrating a basic configuration of a printing apparatus in the present invention.

FIG. 2A is a schematic diagram illustrating a configuration of an example of the printing apparatus 200. The printing apparatus 200 in the present example is what is called a serial scan system in which a print head 201 and an ink portion 202 filled with ink are mounted in a carriage that moves in a main scanning direction of arrow X. The ink portion 202 in the present example is filled with a cyan (C) ink, a magenta (M) ink, a yellow (Y) ink, and a black (K) ink, and the print head 201 ejects these inks. The number of ink colors is not limited to four. A control circuit component 203 includes a storage component, a calculation component, and a communication component needed to drive the print head 201. The print head 201 receives print signals and control signals from the control circuit component 203 to eject the ink in accordance with the control signals. A print medium 204 is conveyed in a sub-scanning direction of arrow Y by a conveying roller not depicted in the drawings. An image is printed on the print medium 204 by alternately repeating an operation in which the print head 201 ejects the ink while moving in the main scanning direction and an operation of conveying the print medium 204 in the sub-scanning direction.

Figure 2B:
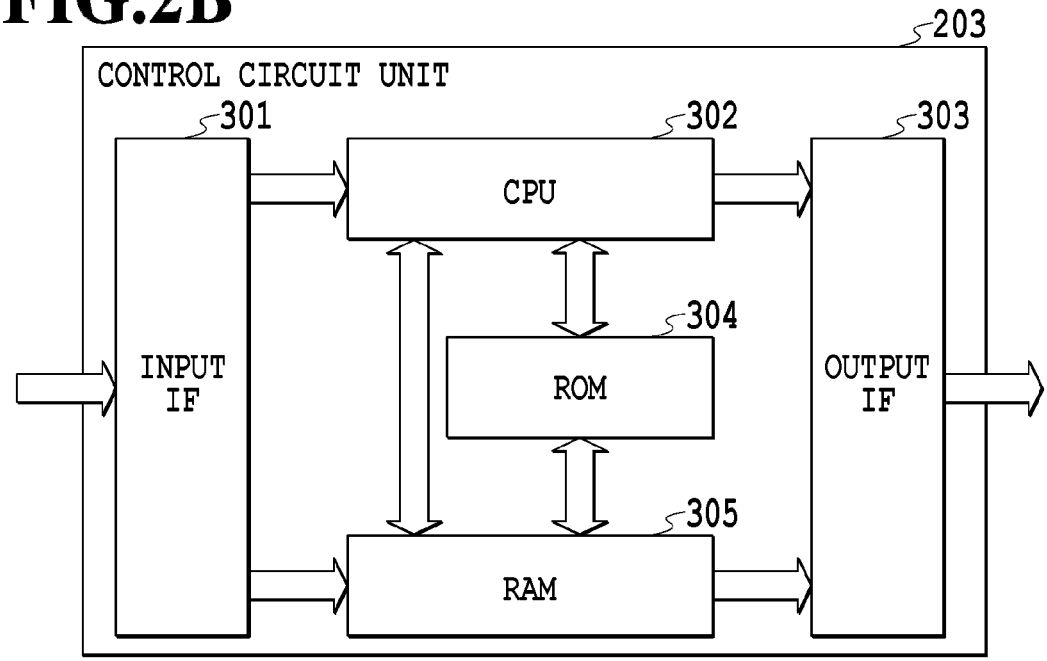
FIG. 2B is a block diagram of a control circuit unit in FIG. 2A.

FIG. 2B is a block diagram illustrating a configuration of the control circuit component 203. The control circuit component 203 includes an input interface 301, a CPU 302, an output interface 303, a ROM 304, and a RAM 305. The input interface 301 accepts image data to be printed and a control signal intended to drive the print head 201, which are input from an operation component, an external computer, or the like, not depicted in the drawings. The input interface 301 sends the image data and the control signals to the RAM 305 and the CPU 302. At this time, the CPU 302 executes a control program stored in the ROM 304 to subject the image data to signal processing. The image data subjected to signal processing is output as print data from the output interface 303 along with the control signal. The print head 201 is driven in accordance with the output print data and control signal to print an image on the print medium 204.

FIG. 2A and FIG. 2B depict a part of hardware configuration of the printing apparatus 200. The printing apparatus 200 can print images while conveying a tray.

First Embodiment

Figure 3:
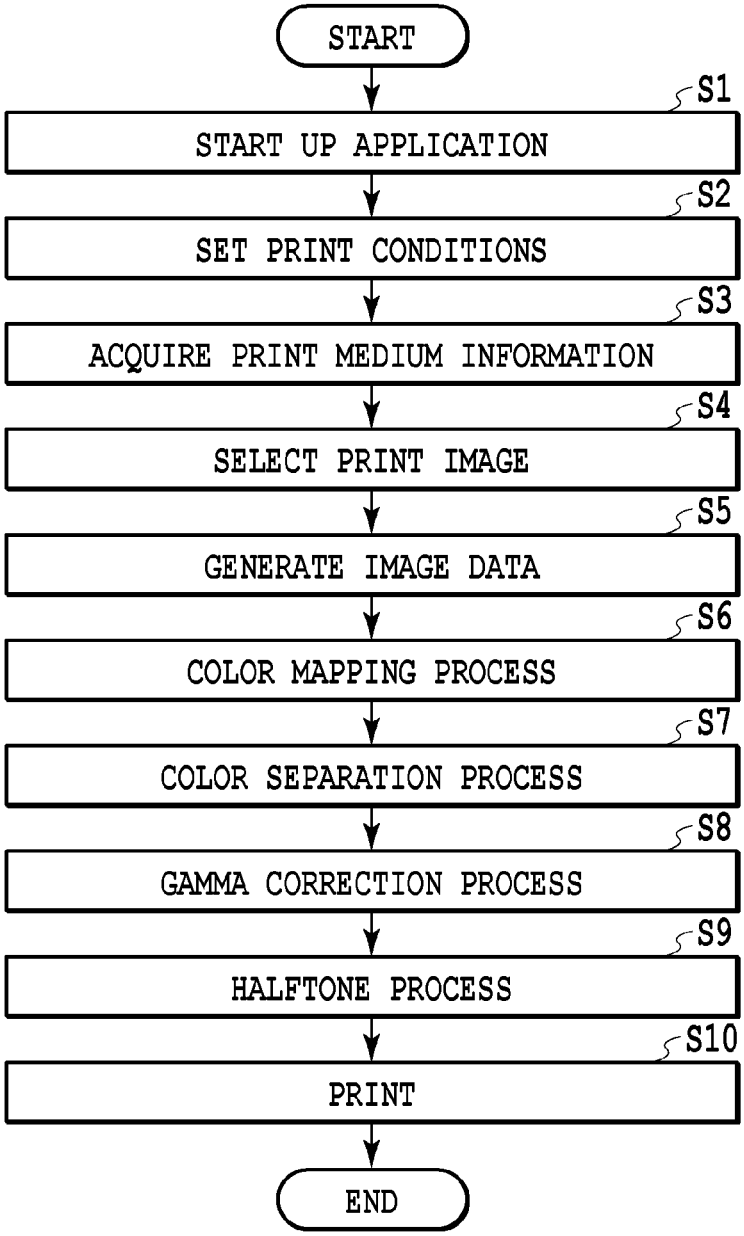
FIG. 3 is a flowchart illustrating information processing in a first embodiment of the present invention.
Figure 4A:
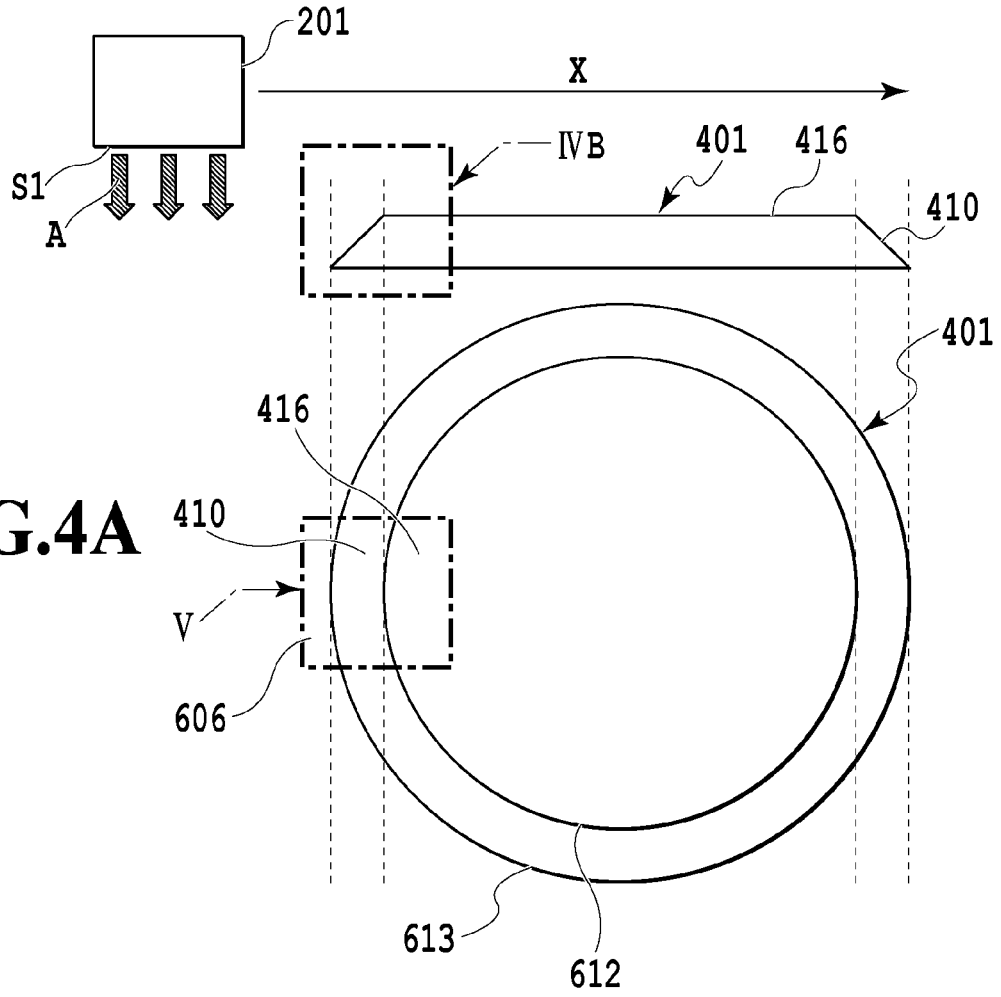
FIG. 4A is a diagram illustrating a relation between an inclination of a print surface of a print medium and ink ejected from a print head.

A first embodiment of the present invention, including the above-described basic configurations, will be described. In the present embodiment, an image is printed on a print medium based on the above-described basic configurations. FIG. 3 is a flowchart illustrating processing executed by application software (hereafter referred to as an "application") in the present embodiment. In the present example, an image is printed on a planar circular print medium 401 with a locally varying thickness as depicted in FIG. 4A.

First, in step S1, an application is initiated in accordance with a user's instruction. The application is stored in the ROM 103, or the like, as a program that is executed by the CPU 102. In a case in which the user gives an instruction to initiate the application using input apparatuses, such as the mouse 107 and the keyboard 108, the application executed in the present embodiment is started up.

Then, print conditions are set (step S2). To achieve this, first, the application acquires information on the printing apparatus 200 via the wireless LAN 111. Specifically, the information is acquired as follows.

That is, printing apparatuses are discovered using a well-known technique. In the present example, printing apparatuses are discovered in the LAN. Once printing apparatuses are found in the LAN, the names of the printing apparatuses can be acquired. The names of the printing apparatuses are displayed in a list so that the user can select, via a UI, a printing apparatus to be used. The application may preclude selection of the printing apparatuses other than an intended printing apparatus. Then, information on printing performed by the printing apparatus is acquired. The information on printing includes the types of print medium that can be printed by the printing apparatus, the sizes of the print medium, print quality, resolution, and the like. The application allows such information on printing to be displayed on the UI so that the user can set the type of print medium, print quality, print color (monochrome or multicolor), the number of sheets printed, a print form (marginless printing or margined printing), and the like. As described below, the setting may be automatically performed. The setting information on printing is subsequently transmitted to the printing apparatus 200.

Then, information on the print medium (print medium information) is acquired (step S3). The information includes information on the shape of the print medium and information on at least one of the thickness (height) and angle (inclination) of the print medium. In the present example, the information is handled in units of pixels corresponding to the resolution of input images accepted by the printing apparatus 200. The resolution corresponds to the information acquired in step S2 and related to the printing performed by the printing apparatus. The print medium information need not be held at an input resolution of the printing apparatus, and may be held at another resolution before being scaled to the input resolution of the printing apparatus. For this scaling process, for example, a well-known technique such as bilinear may be used.

Figure 4B:
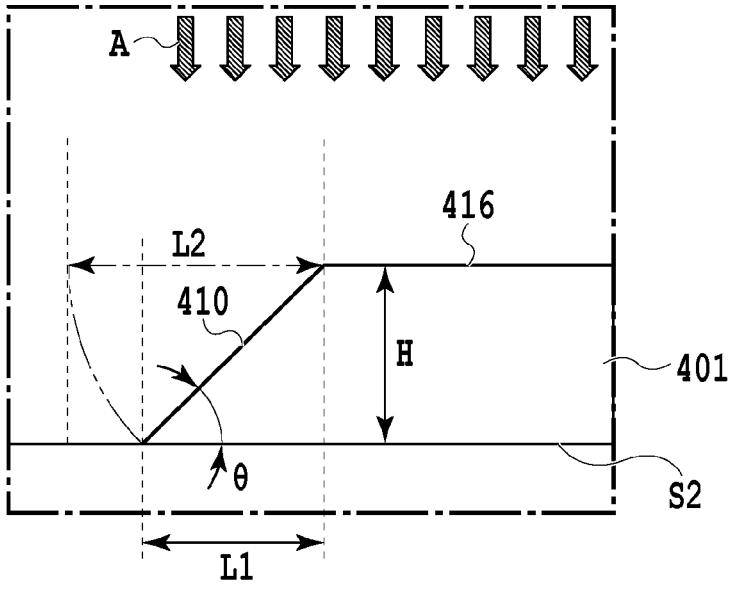
FIG. 4B is a diagram illustrating a part IVB in FIG. 4A.

FIG. 4A and FIG. 4B are diagrams illustrating the print medium 401 on which an image is to be printed. The print medium 401, which is planar and circular, has a flat portion 416 formed in the center of the print medium 401 and which is parallel to a reference surface S2, and an inclined portion 410 formed around the flat portion 416. As depicted in FIG. 4A, a print head 201 ejects ink in the direction of arrow A to the print medium 401, which has a locally varying thickness, to print an image on the print medium 410. FIG. 4B is an enlarged view of a part IVB in FIG. 4A. The reference surface S2 as used herein refers to a loading surface on which the print medium 401 is loaded and which is contacted by a bottom surface of the print medium 401. The reference surface S2 may also be a support surface of a support member, such as a mount 804 or a tray 1001, described below, which is configured to support the print medium, the support surface being contacted by the print medium. The reference surface S2 is basically parallel to a surface S1 of the print head 201 in which ejection ports are formed.

The ink ejected from the print head 201 in the direction of arrow A substantially and perpendicularly impacts a surface of the flat portion 416 of the print medium 401, but obliquely impacts a surface of the inclined portion 410. In a case in which the print medium 401 is viewed in plan, the inclined portion 410 has a radial length L1. In a case in which the print medium 401 is viewed in side, the inclined portion 410 has a length L2 (L2>L1) in an inclining direction. In other words, in a plan view in which the print medium 401 is seen in a direction in which the print head 201 ejects the ink, the length L1 of the inclined portion 410 is shorter than the length L2 of the inclined portion 410 in the inclining direction. In a case in which the print surface of the print medium 401 is treated as a two-dimensional element and the entire print surface is similarly printed, the image quality is lower at the inclined portion 410. Specifically, only a volume of ink needed for the area of the inclined portion 410 corresponding to the length L1 impacts the area of the inclined portion 410 corresponding to the length L2. Thus, a part of the image printed on the inclined portion 410 may have an unexpected pale color.

FIG. 5 is a diagram of print medium information 603 on a part V, in FIG. 4A, of the print medium 401. Square areas containing the respective numerical values each correspond to one pixel for the input resolution of the printing apparatus 200. FIG. 5 depicts only the print medium information on the part V in FIG. 4A for simplification of description. The print medium information includes at least information on pixels corresponding to the entire area of the inclined portion 410 of the print medium 401. The amount of data in the print medium information can be reduced by, for example, compressing the print medium information using a well-known compressing technique and restoring the uncompressed information before use, or in a case in which the pieces of information on the flat portion 416 are contiguous, omitting the corresponding pixels.

The numerical values in the pixels in the print medium information 603 are magnification information (information on the inclination) that is the ratio of the length L2 to the length L1 in FIG. 4B. The pixels in a pixel group 607 corresponding to the flat portion 416 all have a "1" magnification. The pixels in a pixel group 608 corresponding to the inclined portion 410 all have an approximately "$\sqrt{2}$ ($\approx$1.4)" magnification. The reason is that, in a case in which an inclination angle $\theta$ (see FIG. 4B) of a printed surface of the inclined portion 410 with respect to the reference surface S2 is 45 degrees and the L1 is "1", the length L2 is "$\sqrt{2}$". The magnification is determined using the following equation. (45° [degree]=$\pi$/4[radian]).

$$\text{Magnification}=1/\text{COS}(\pi/4)=\sqrt{2}$$

As described above, the magnification, which is print medium information, is obtained based on the angle (inclination) $\theta$.

Given a height (thickness) H of the flat portion 416 and the length L1 of the inclined portion 410, the magnification may be determined by determining the length L2 of the inclined portion 410 determined based on Pythagorean theorem and then comparing the length L1 with the length L2. In this case, the magnification, which is print medium information, is obtained based on the height (thickness).

In FIG. 5, a boundary line 612 (see FIG. 4A) between the flat portion 416 and the inclined portion 410 is represented by a dotted line 614, and an outer edge 613 (see FIG. 4A)

of the print medium 401 is denoted by a dotted line 615. An area 607 corresponding to the flat portion 416 has a "1" magnification, and an area 608 corresponding to the inclined portion 410 has a "√2" magnification. In contrast, the vicinity of the dotted line 614 corresponding to the boundary line 612 has a magnification between the "1" magnification and the "√2" magnification. The reason is that the boundary between the flat portion 416 and the inclined portion 410 of the print medium 401 lies within one pixel for a print resolution of the printing apparatus. Numerical values may be determined by calculation already weighted in accordance with the ratio between the area of the flat portion 416 and the area of the inclined portion 410 in one pixel. The numerical values may then be held. The application may arithmetically determine the magnifications during a printing operation instead of holding such predetermined numerical values. An increased print resolution of the printing apparatus 200 enables a reduction in the size of each square area in FIG. 5 corresponding to one pixel for the print resolution, with the square areas filled with the respective numerical values. Thus, the image can be more accurately printed at the boundary portion 614.

The area 608 corresponding to the inclined portion 410 has a "√2" magnification, and the vicinity of the dashed line 615 corresponding to the boundary line 613 has a "√2" magnification. In an area 609 corresponding to an area 606 in FIG. 4A in which the print medium 401 is not present, an area 610 close to the boundary line 615 has a "√2" magnification. As a method for printing an image even at an end of the print medium 401, a technique is known in which the image is printed on an area located slightly outward of the end. In a case in which the image is printed on the area 610 in which the print medium 401 is not present, what is called marginless printing can be achieved with no margin formed in the boundary portion 613. At this time, in a case in which a structure configured to absorb ink is provided in the area 606 located outward of the print medium 401, printing operations can be achieved with no ink attached to the print medium 401, the printing apparatus, or the user's hand.

The print medium information may be acquired by loading data held in the memory by the application or acquired from the server via the internet. In a case in which the print medium information is acquired via the server, for example, the ID of the print medium may be sent to the server, which then sends the print medium information corresponding to the ID back to the printing apparatus. In a case in which dedicated application corresponding to the print medium is used, the need for selection of the print medium or management based on the ID is eliminated. Thus, in a case in which the dedicated application is started up, the print medium information can be acquired from the memory. Such a dedicated application allows the print conditions to be automatically set. The print medium information acquired may include not only the above-described magnification but also the maximum value of the magnification and information indicating whether or not the print medium has an inclined portion.

In step S4 in FIG. 3, an image to be printed is selected. Specifically, the application displays an image select screen so that the user can select one of the images present in the information processing apparatus 100 or the printing apparatus 200. The selection may be performed by the user touching the touch panel, which is input equipment.

The selection of the image to be printed is not limited to the above-described method but may be automatically performed. For example, the images in the information processing apparatus 100 may be analyzed and human faces and smiling faces may be detected using a well-known technique so that an image depicting a face with a high level of smiling can be automatically selected. The images for selection are not limited to the images in the information processing apparatus 100, but images present in the external server 116 may be downloaded via the internet 115. Various types of processing may be executed: a process in which the user sets the arrangement position of the image according to the shape of the print medium, a correction process for sharpness, colors, or the like, a process for changing the sizes of parts in a photograph such as the human eyes, and a process for adding any objects to the human face.

In the subsequent step S5 in FIG. 3, the application generates image data. That is, image data suitable for printing is generated based on the print medium information acquired as described above. In the present example, based on the resolution of the printing apparatus 200, which is a part of the information on the printing acquired in step S2, an image with a number of pixels corresponding to the resolution is generated.

FIG. 6 is a diagram illustrating some of image signals for R (Red), G (Green), and B (Blue) generated by the application, and represents signal values corresponding to the pixels in the print medium information 603 in FIG. 5. Portions in FIG. 6 that are similar to the corresponding portions in FIG. 5 are denoted by the same reference numerals, and will not be described below. In the present example, a blue image is printed all over the surface of the print medium 401 for simplification of description. An R value, a G value, and a B value for blue for the input image are (0, 0, 255).

The numerical value in each square area in FIG. 6 corresponding to one pixel is mathematically determined by the application, and is indicative of an 8-bit signal value for R (Red) or G (Green) in the RGB image signal. In the present example, the signal value for B (Blue) is "255" for all the pixels. In other words, in FIG. 6, pixels labeled "255" has R, G, B values of (255, 255, 255), and pixels labeled "75" has R, G, B values (75, 75, 255). As described below, in a case in which the R, G, B values are (75, 75, 255), a normal blue image is printed on the flat portion 416 of the print medium 401.

The numerical values in FIG. 6 can be determined using the signal values for the pixels (in the present example, all the pixels have R, G, B values of (0, 0, 255)) and the signal values for the pixels in the print medium information 603 in FIG. 5. In the present example, the following equation is used.

$$\mathrm{Sig}R=255-(\mathrm{Sig}W-\mathrm{Sig}P)P\mathrm{pix}/P\mathrm{max}$$

The signal value for the pixel to be determined is denoted by SigR. The signal value for white is denoted by SigW, that is, "255". The signal value for the pixel is denoted by SigP, and is R, G, B=0, 0, 255 for blue as in the present example. The magnification for the pixel is denoted by Ppix and corresponds to each of the numerical values (information on the inclination) indicated in FIG. 5. The maximum value of the magnification is denoted by Pmax and is "√2" in the case of the example in FIG. 5.

In the above-described equation, the signal value is represented in 8 bits such that setting the maximum value Pmax of the magnification to "√2" results in blue, which has the maximum density (in the present example, (0, 0, 255)). Based on a distance, in an RGB color space, from white (255, 255, 255), which has the minimum density, the signal value with a magnification of √2 is represented in 8 bits. Any color between white (255, 255, 255) and the signal value with a magnification of √2 is determined based on the distance from white (255, 255, 255) in the RGB color space.

In the present example, the signal value is calculated so as to be represented in 8 bits. The present invention is not, however, limited to this representation. For example, an output image may be represented in 16 bits. In this case, a color mapping process and the like described below need to be formed to accept 16-bit inputs. This allows prevention of inappropriate reproduction of gradation that may result from representation of the signal value in 8 bits.

Image data including the thus determined signal values is transmitted to the printing apparatus 200 as a print job. The print job includes information indicating that the image is to be printed on a print medium with an inclined portion. The information may be described using any tab in XML format. In that case, a numerical value in the tab may be "1" for a normal print medium with no inclined portion and "√2 (=1.4)" for a print medium with an inclined portion. Generally, many prevailing printing apparatuses each have a plurality of print modes, and thus, a dedicated print mode for printing of an image on a print medium with an inclined portion may be provided and selected to allow similar information to be communicated to the printing apparatus 200.

Then, in step S6 in FIG. 3, a color mapping process is executed in the printing apparatus 200. The color mapping is a process for converting a color space for an input image into a color space for an output image from the printing apparatus 200. In the present example, a three-dimensional lookup table (3DLUT) is used, and RGB values generated in step S5 are input to the lookup table to generate signals R', G', B' for the color space for the output image from the printing apparatus 200. The 3DLUT is set such that input RGB values of (75, 75, 255) allow a normal blue image to be printed on the flat portion 416 of the print medium 401. The 3DLUT is further set such that input RGB values of (0, 0, 255) allow the same color as the normal blue in the flat portion 416 to be printed on the inclined portion 410. The 3DLUT is further set so as to output a value resulting from interpolation for colors with RGB values between (75, 75, 255) and (0, 0, 255).

Then, in step S7, a color separation process is executed. The color separation process allows the R', G', and B' signals generated in step S6 to be converted into signals corresponding to ink color materials for cyan (C), magenta (M), yellow (Y), black (Bk), and the like. Also in this process, a 3DLUT (hereinafter referred to as the "color separation LUT" is used to convert the three-dimensional signals R', G', B' into four signals C, M, Y, K corresponding to four color inks. The color separation LUT is normally limited depending on the print medium and combination of the inks. For example, in a case in which excessive volumes of color material such as ink are ejected to the print medium, the color materials may overflow the print medium instead of being absorbed by the print medium, bleed, or become likely to peel off as a result of rubbing. Thus, for the normal color separation LUT, the output signal value is set so as to limit the volume of each ejected color material within a predetermined tolerable range.

The color separation LUT can be created using a well-known technique. The color separation LUT in the present example, however, allows the volume of each ejected color material to be √2 times as large as the maximum volume of the ejected color material in the normal color separation LUT as described above. This also enables dense colors to be reproduced in the inclined portion 410.

Then, in step S8, a gamma correction process is executed. Normally, in a case in which the color material such as ink is ejected to the print medium, a well-known physical phenomenon inhibits the density, brightness, and saturation of the print image from linearly varying even with an increase in the volume of the color material ejected. The gamma correction in the present example performs correction such that the density, brightness, and saturation of the print image or a composite value thereof from linearly varying according to the output from the color separation LUT. Such gamma correction can be achieved using a one-dimensional lookup table (gamma correction 1DLUT) for each color material or the like by well-known technique. As described above, however, in a case in which excessive volumes of color materials such as ink are ejected to the print medium, the color materials may overflow the print medium instead of being absorbed by the print medium, bleed, or become likely to peel off as a result of rubbing. Thus, for the normal color separation LUT, the output signal value is set so as to limit the volume of each ejected color material within the predetermined tolerable range.

The gamma correction 1DLUT can be created using a well-known technique. Like the color separation LUT, however, the gamma correction 1DLUT in the present example allows the volume of each ejected color material to be √2 times as large as the maximum volume of the ejected color material in the normal gamma correction 1DLUT as described above. This also enables dense colors to be reproduced in the inclined portion 410.

Then, in step S9, a halftone process is executed based on the output signal values of the gamma correction process in step S8. The halftone process is executed based on a well-known dither method or error diffusion method to generate a binary or multi-value image signal. The printing apparatus 200 uses the image signal to print an image on the print medium (step S10).

A printing operation is assumed in which the same image printed on the flat portion (first surface portion) 416 and on the inclined portion (second surface portion) 410. In a case in which the information on the inclination of the print surface is reflected in the image data as described above, the volume of ink ejected (applied) per unit area of the inclined portion 410 is larger than the volume of ink ejected (applied) per unit area of the flat portion 416.

The printing apparatus 200 varies a moving speed (print speed) of the print head depending on whether or not the print medium has an inclined portion. The print head 201 in FIG. 2A prints an image by ejecting the ink while reciprocating in the direction of arrow X. Compared to a normal print medium including only a flat portion and no inclined portion, a print medium including an inclined portion as in the present example needs ejection of up to approximately 1.4-fold volume of ink. In that case, in a case in which the print head 201 is driven at a speed similar to a speed for a normal print medium including only a flat portion, a needed volume of ink may fail to be ejected. The reason is that the ink is fed through thin channels to the ejection ports in the print head, and thus, in a case in which the print head is driven at a speed higher than a speed corresponding to the duration of ink feeding, the ink fails to be ejected. In a case in which the print head is driven at an excessively high speed, the supply of electric signals to ejection energy generation elements (electrothermal transducing elements (heaters) or piezoelectric elements) may fail to keep up with the driving of the print head.

Consequently, in the present example, in a case in which information is acquired that indicates the presence of an inclined portion in the print medium, the driving speed of the print head is set at least 1.4 times lower than the driving speed for a normal print medium for printing. This enables more ink to be ejected than in the case of a normal print medium. Ink landing accuracy is higher at a reduced driving speed of the print head than at a high driving speed of the print head. Similar effects can be produced by changing the number of print passes (the number of scans) in a case in which information indicative of the presence of an inclined portion is acquired. In this case, with the print head driven at a speed similar to the speed during a normal printing operation, the number of times (passes) when the print head passes over a predetermined area on the print medium is increased. At this time, according to the number of passes, the amount by which the print medium is conveyed in the direction of arrow (y) in FIG. 2A is made smaller than during the normal printing operation. As described above, in a case in which a multi-pass printing system that prints an image through a plurality of passes over a predetermined area is adopted to increase the number of times when the print head passes over the predetermined area of the print medium, the opportunity for the print head to eject the ink to the predetermined area is increased. As a result, a larger volume of ink can be ejected to the predetermined area of the print medium. Similar effects can be produced by varying the number of passes between the flat portion and the inclined portion of the print medium so as to reduce a scan speed of the print head and/or increase the number of passes in the inclined portion.

The printing method for the printing apparatus is not limited to a serial scan method as illustrated in FIG. 2A, but various printing methods may be adopted. For example, a full line method may be adopted in which an image is printed by using an elongate print head extending over the a print area of the print medium in a width direction thereof, and allowing the print head to eject the ink while continuously conveying print medium. The printing apparatus is effectively applicable to any of the printing methods. In the full line method, similar effects can be produced by reducing a conveying speed for print medium.

Alternatively, in a case in which information indicative of the presence of an inclined portion is acquired, the image print resolution may be made higher than during the normal printing operation. In steps S5 to S9 in FIG. 3 in which print data is generated, not all of the print pixels need to be processed before the process proceeds to the next step. For example, in step S5, an operation of cutting the image to be printed into band-like pieces may be performed instead of generation of all of the image data for printing, and the image may be processed in units of the bands in order from top to bottom to generate image data in units of bands. The image data may be sequentially transmitted to the printing apparatus. In this case, the processing in steps S6 to S9 can be sequentially executed on the image data in units of bands. As a result, the temporal efficiency of these processes is improved, enabling a reduction in time needed to complete the printing.

A reduced driving speed of the print head provides a more than enough processing speed for each step in FIG. 3. Even in a case in which the process from step 1 through the half tone process (step S9) is executed at a high speed, data processing jobs are congested and need to wait in line in a case in which the print speed fails to keep up with the processing speed. In such a case, the increase of the print resolution is effective. In general, an increase in the number of pixels to be processed increases the corresponding duration of processing in a proportional manner. In other words, an increased print resolution of the image to be output to the printing apparatus increases the corresponding duration of processing. Furthermore, the increased resolution enables the image to be expressed in detail to enhance print quality. Alternatively, the print image for the inclined portion of the print medium may exclusively be processed at a high resolution. In a case in which the resolution of the image is the same for the flat portion 416 and for the inclined portion 410 in FIG. 4A, the resolution of the print image for the inclined portion 410 is $1/\sqrt{2}$ ($\approx 0.71$) of the resolution of the print image for the flat portion 416. The reason is that only the same number of pixels as needed for the area of the inclined portion 410 proportional to the length L1 are provided the area of the inclined portion 410 proportional to the length L2. Consequently, increasing the resolution only of the print image for the inclined portion 410 allows suppression of deterioration of image quality resulting from a decrease in the resolution for the inclined portion 410.

As described above, changing the print conditions for printing allows the image quality for the inclined portion of the print medium to be restrained from being deteriorated. Therefore, in a case in which the height of the print medium locally varies, for the flat portion 416 as depicted in FIG. 4A, the image can be printed with the colors normally reproduced, whereas, for the inclined portion 410 as depicted in FIG. 4A, a favorable image can be printed with the colors restrained from being pale.

Similar effects can be exerted on a print medium including only an inclined portion and no flat portion. For example, similar effects can be exerted on a print medium with the same inclination formed all over the surface of the print medium, a print medium with a undulating surface including peaks and troughs (for example, a jagged surface). In the above description, the inclination angle is 45 degrees by way of example. The present invention is not, however, limited to this value. The inclination angle may have any other value, and the magnification can be calculated using the above-described calculation formula. In a case in which one print medium has a plurality of inclined portions inclined at different angles, similar effects can be produced by determining, for each position, the magnifications corresponding to the respective angles and storing the magnifications as print medium information.

Variation of the First Embodiment

In the first embodiment, in step S5 in which the image data is generated, the signal values (RGB values) for the pixels that are input to the printing apparatus are calculated based on the magnifications (Ppix) for the pixels. The present invention is not, however, limited to this calculation. In a variation of the first embodiment described below, step S5 involves rendering the print image at least for the inclined portion based on a normal resolution conversion process, instead of calculating the RGB values based on the magnification for each pixel. To the printing apparatus, the print medium information acquired in step S3 is transmitted simultaneously with transmission of a print job.

Variation 1 of the First Embodiment

In the present example, a process based on the magnification (Ppix) for the pixels is executed during the color mapping process. That is, in step S6, the color mapping process is executed based on the print medium information received simultaneously with reception of the print job. Specifically, as is the case with step S5 in the first embodiment, the R, G, B values are changed based on the magnification for each pixel included in the print medium information, and based on the changed R, G, B values, the mapping process is executed using the above-described 3DLUT. Step 7 and the subsequent steps are similar to the corresponding steps in the first embodiment.

The process based on the magnification for each pixel is executed by the printing apparatus as described above and thus need not be performed by the application.

Variation 2 of the First Embodiment

In the present example, the process based on the magnification (Ppix) for the pixels is executed during the color separation process. That is, in step S6, instead of the process based on the magnification for each pixel, the normal color mapping process using the 3DLUT is executed. As a result of the color mapping, the R', G', B' values are calculated. The color separation process in step S7 uses the R', G', B' values as input to output the signal values for the color materials corresponding to the respective pixels. At this time, the output from the color separation LUT is multiplied by the magnification (Ppix) for the pixels. The results of the multiplication are used as output values from the color separation. Step 8 and the subsequent steps are similar to the corresponding steps in the first embodiment.

The process based on the magnification for each pixel is executed during the color separation process as described above. This allows the technique in the present invention to be relatively easily implemented using the existing application and color mapping without the need to incorporate a special process into the application or color mapping.

Variation 3 of the First Embodiment

In the present example, the process based on the magnification (Ppix) for the pixels is executed during the gamma correction process. From step 1 to step 7, the process based on the magnification for each pixel is not executed but a common process is performed. In the gamma correction process in step S8, the signal values for the color materials corresponding to the respective pixels are output using the 1DULT. At this time, the output values from the 1DLUT are multiplied by the magnification for each pixel. The results of the multiplication are used as output values from the gamma correction process.

In the printing steps subsequent to the gamma correction process, in a case in which the volume of the ejected color material such as ink fails to have a proportional relation with input values to the half tone process, the corresponding nonlinear portion may be absorbed and corrected by the gamma correction process to make the relation linear. In that case, a table is used in which the output values from the gamma correction process are associated with an output corresponding to the ejection volume of the color material (color material volume) ejected per unit area. In the table, the color material volume may be represented in units of nanograms (ng). Such a table is used to execute back calculation to determine the output values from the gamma correction process corresponding to the color material volume. The color material volume corresponding to the output values from the normal 1DLT is determined and multiplied by the magnification for each pixel. Then, the output values from the gamma correction corresponding to the resultant color material volume are determined as the output values from the gamma correction process (step S8).

Such a process allows the volume of the color material ejected to the inclined portion 410 to be increased by an amount equal to the ratio of the area of the inclined portion 410 corresponding to the length L2 to the area of the inclined portion 410 corresponding to the length L1 to restrain the color of the image printed on the inclined portion 410 from being pale. Thus, favorable print matter can be created. In this process, the volume of ink ejected per unit area of the inclined portion can be made approximately equal to the volume of ink ejected per unit area of the flat portion. The process is thus effective for reducing the difference in image quality between the inclined portion and the flat portion.

Second Embodiment

The present embodiment uses an application and a printing apparatus similar to those in the first embodiment. For simplification of description, components of the second embodiment that are similar to the corresponding components of the first embodiment are denoted by the same reference numerals and will not be described.

Figure 7:
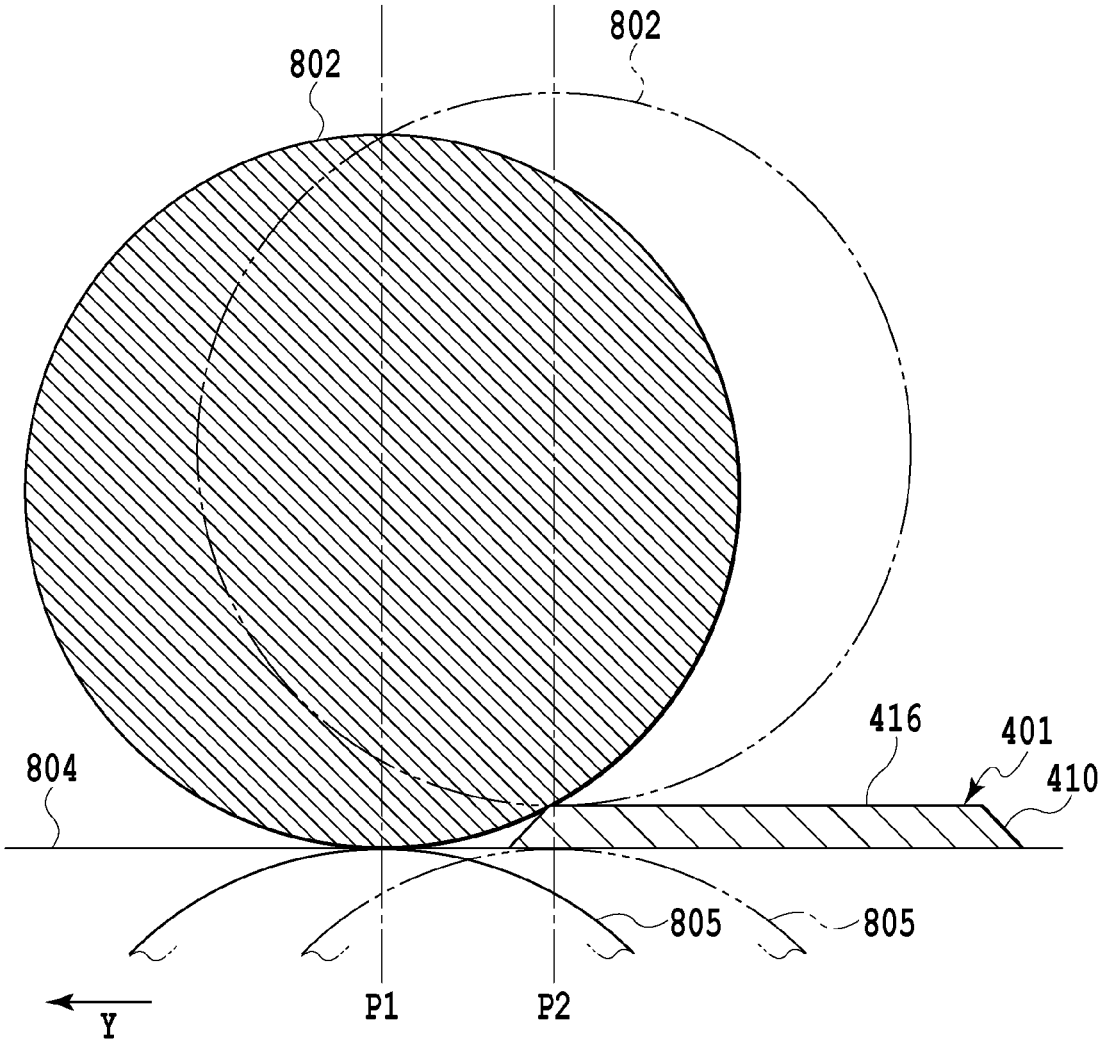
FIG. 7 is a diagram illustrating a comparative example for a second embodiment of the present invention.

FIG. 7 is a diagram illustrating a configuration in which the print medium 401 with a locally varying height is conveyed by rollers 802, 805. The print medium 401 is a seal-like print medium 401 having the flat portion 416 and the inclined portion 410. The print medium 401 is stuck to a mount 804. A driving roller 805 is rotated by being rotationally driven by a motor not depicted in the drawings. A pinch roller 802 holds the print medium 401 between the pinch roller 802 and the driving roller 805. The driving roller 805 is rotationally driven to convey the print medium 401 in the direction of arrow Y.

While in contact with the mount 804 at a position P1, the pinch roller 802 is in a lower position as depicted by a solid line in FIG. 7. When the print medium 401 is conveyed in the direction of arrow Y along with the mount 804 and the pinch roller 802 contacts the print medium 401 at a position P2, the pinch roller 802 is displaced to an upper position as depicted by a dotted line in FIG. 7. The pinch roller 802 holds the print medium 401 between the pinch roller 802 and the driving roller 805 as described above, and thus moves up and down depending on the thickness of the print medium 401. Such up-and-down movement of the pinch roller 802 may reduce conveying accuracy for the print medium 401.

As described above, for the print medium with the inclined portion, in particular, the accuracy at which the ink lands on the inclined portion is important, and a decrease in the conveying accuracy for the print medium may deteriorate the image quality of the printed image.

FIGS. 8A to 8H are diagrams illustrating a tray 1001 used to print an image on a print medium in the present embodiment. FIG. 8A is a plan view of the tray 1001, and FIG. 8B is a sectional view taken along line in FIG. 8A. A recess 1008 is formed in the tray 1001 so that a print medium 1003 can be positioned in the recess 1008. The print medium 1003 corresponds to the print medium 401 stuck onto the mount 804 as depicted in FIG. 7. FIG. 8C is a plan view of the print medium 1003, and FIG. 8D is a sectional view taken along line VIIID-VIIID in FIG. 8C. FIG. 8E is a plan view illustrating that the print medium 1003 is fitted into the recess 1008 in the tray 1001. FIG. 8F is a sectional view taken along line VIIIF-VIIIF in FIG. 8E. FIG. 8G is a plan view of the pinch roller 802, and FIG. 8H is a side view of the pinch roller 802. The width W1 of the pinch roller 802 is larger than the width W2 of the tray 1001.

Figure 9:
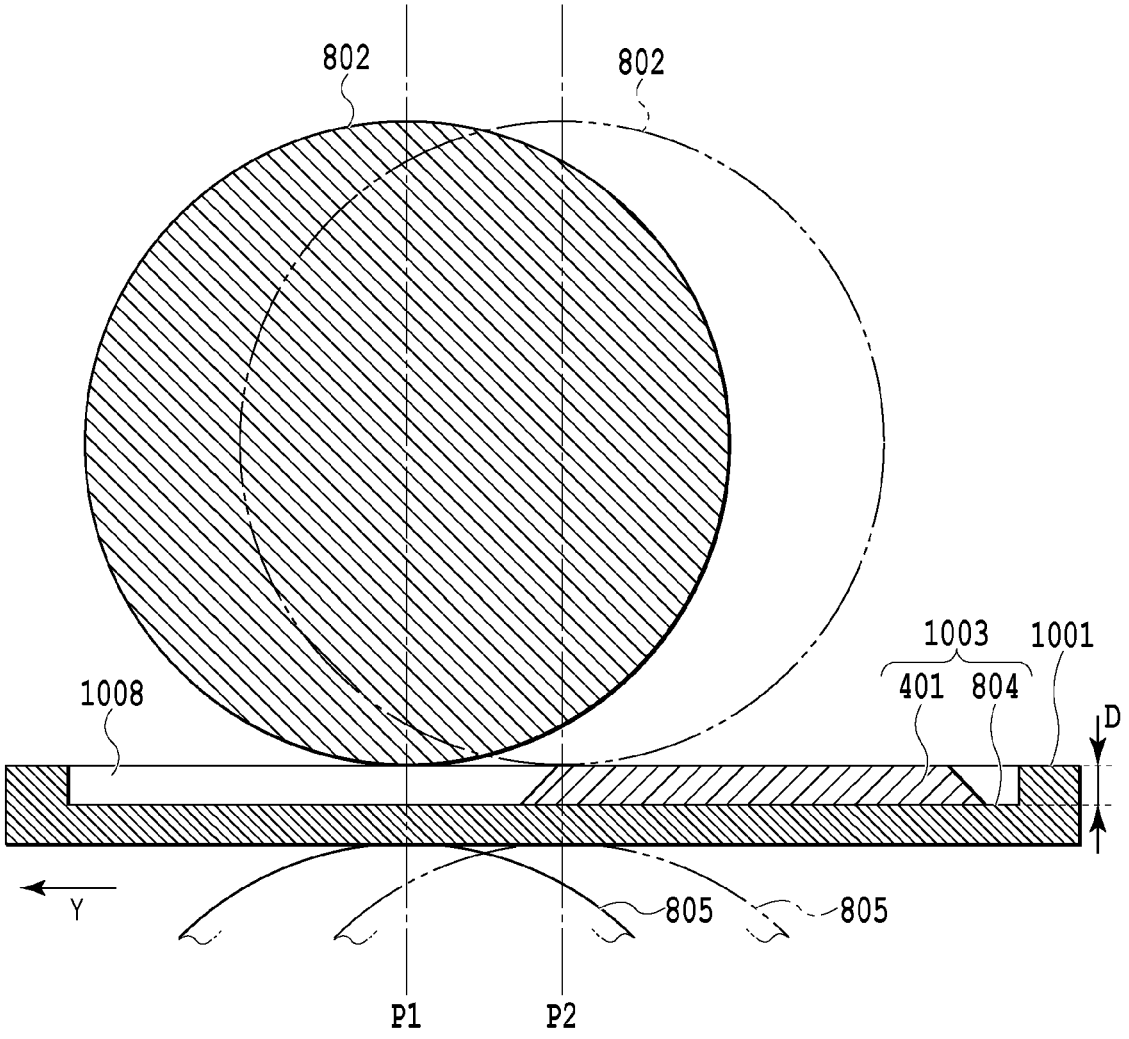
FIG. 9 is a diagram illustrating a conveying state of the print medium in the second embodiment of the present invention.

FIG. 9 is a diagram illustrating a state in which the tray 1001 with the print medium 1003 positioned therein is conveyed by the rollers 802, 805, which are similar to the rollers 802, 805 in FIG. 7. The height of the pinch roller 802 remains unchanged regardless of whether the pinch roller 802 contacts the tray 1001 at the position P1 or at the position P2. The tray 1001 is sandwiched between the pinch roller 802 and the driving roller 805, and the thickness of the print medium 1003 is equal to or smaller than the depth D of the recess 1008. Thus, the pinch roller 802 is inhibited from moving up and down. As a result, the print medium 1003 can be accurately conveyed to suppress displacement of the landing position of the ink, allowing a high-quality image to be printed on the print medium 1003.

Variation of the Second Embodiment

Figure 10C:
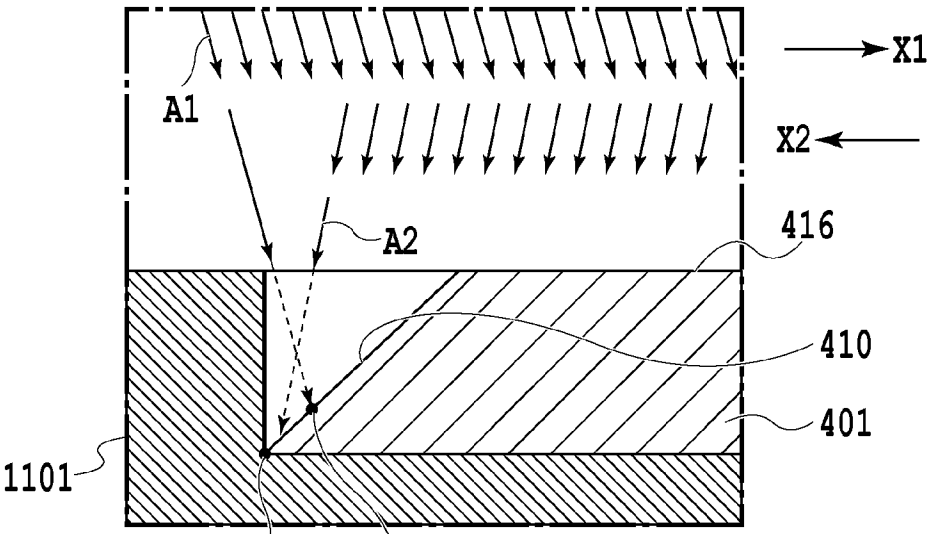
FIG. 10C is an enlarged view of a part XC in FIG. 10B.
Figure 10A:
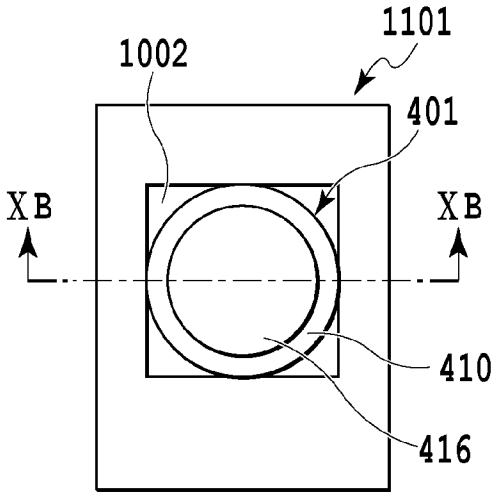
FIG. 10A is a plan view of a tray in a variation of the second embodiment of the present invention.
Figure 10B:
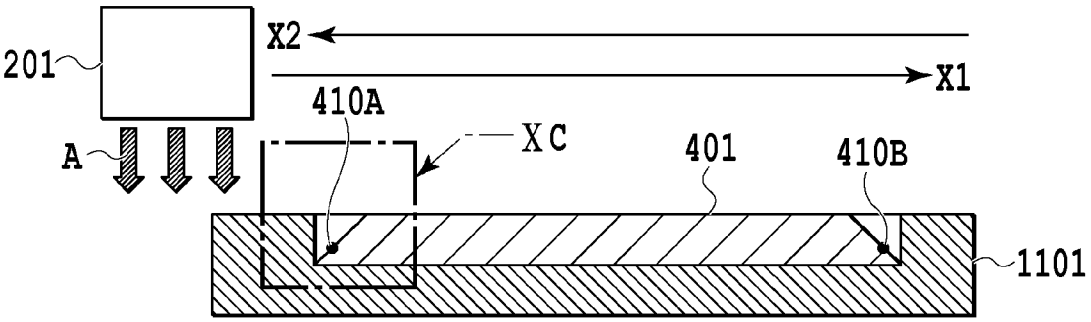
FIG. 10B is a sectional view taken along line XB-XB in FIG. 10A.

FIG. 10A is a plan view of a tray 1101 in the present example. A recess 1102 is formed in the tray 1101 so that the print medium 401 can be positioned in the tray 1101. FIG. 10B is a sectional view taken along line XB-XB in FIG. 10A, and FIG. 10C is an enlarged view of a part XC in FIG. 10B. In the present example, a printing apparatus configured to print an image on the print medium 401 is based on what is called a bidirectional printing method. That is, the print head 201 prints an image by ejecting ink while moving in a forward direction of arrow X1 (forward printing), and also prints an image by ejecting ink while moving in a backward direction of arrow X2 (backward printing). An outer peripheral edge 401A of the print medium 401 is in contact with an inner peripheral portion of the recess 1102 in the tray 1101. In a case in which the tray 1101 and the print medium 401 are thus in contact with each other, the application generates or acquires an image in one channel. The image is transmitted to the printing apparatus simultaneously with transmission of a corresponding print job.

Since the print head 201 ejects the ink in the direction of arrow A while moving in the directions of arrows X1, X2, the ejection direction of the ink is tilted in a moving direction of the print head 201, though the tilt is slight. Arrow A1 in FIG. 10C represents the ejection direction of the ink in a case in which the print head 201 ejects the ink while moving in the direction of arrow X1. In a case in which an attempt is made to print an image on a part 410A on the inclined portion 410 of the print medium 401, the ink is interrupted by the tray 1101 as depicted in FIG. 10C. This precludes an image from being printed on an area the left of the part 410A in FIG. 10C. Arrow A2 in FIG. 10C represents the ejection direction of the ink in a case in which the print head 201 ejects the ink while moving in the direction of arrow X2. The ink ejected in the direction of arrow A2 is not interrupted by the tray 1101 as depicted in FIG. 10C and allows an image to be printed even on the area to the left of the part 410A.

Therefore, the part 410A on the inclined portion 410 can be printed with the ink ejected in the direction of arrow A2 in the case in which the print head 201 moves in the direction of arrow X2 such that the ink is prevented from being interrupted by the tray 1101. On the other hand, a part 410B on the inclined portion 410 can be printed with the ink ejected in the direction of arrow A1 in the case in which the print head 201 moves in the direction of arrow X1 such that the ink is prevented from being interrupted by the tray 1101.

The user makes settings on the application through the UI so as to allow an image to be printed on a combination of the print medium and the tray. In that case, the application acquires a prepared image in one channel from the relevant file. The image is information (moving direction information) on the moving direction of the carriage corresponding to the moving direction of the print head, and has as many pixels as the image data generated in step 5 in FIG. 3 described above. The moving direction information has a pixel value of "1" in a case in which the print head is instructed to print an image when moving in the direction of arrow X1 and a pixel value of "2" in a case in which the print head is instructed to print an image when moving in the direction of arrow X2. In a case in which printing is possible in both directions of arrows X1, X2, the moving direction information has a pixel value of "0".

Such moving direction information is transmitted simultaneously with transmission of the corresponding print job. The printing apparatus receives the moving direction information to print an image in the indicated moving direction. In a case in which a sufficient volume of ink is ejected to the print medium both by printing during movement in the direction of arrow X1 and by printing during movement in the direction of arrow X2, a sufficient volume of ink fails to be ejected simply by the printing during the movement in one direction. In such a case, to allow a sufficient volume of ink to be ejected simply by the printing during the movement in one direction, the number of passes of the print head over the print area of the print medium is increased to increase the opportunities of ink ejection. The image processing based on the magnification for each pixel as in the first embodiment allows suppression of deterioration of image quality associated with a decrease in the volume of ink ejected to the inclined portion.

As described above, in a case in which an image is printed on a part of the print medium positioned at the edge of the tray, the moving direction of the print head is selected for printing of an image on that part. Specifically, for the part 410A in the left of FIG. 10B, an image is printed during the movement in the direction of arrow X2, and for the part 410B in the right of FIG. 10B, image is printed during the movement in the direction of arrow X1. Consequently, an image can be printed on the edge of the print medium even in a case in which the tray is used.

Third Embodiment

In the first embodiment described above, the magnification for the inclined portion of the print medium is acquired, and based on the magnification, the volume of the color material such as ink ejected to the inclined portion is increased. In the present embodiment, the volume of the color material ejected is reduced rather than being increased. The present embodiment uses an application and a printing apparatus similar to those in the first embodiment. For simplification of description, only differences from the first embodiment will be described, and elements of the third embodiment similar to the corresponding elements of the first embodiment will not be described below.

In the present embodiment, print medium information on the print medium 401 having the inclined portion 410 as depicted in FIG. 4A is acquired and includes magnifications used to gradate the print image for the inclined portion 410. The print medium information includes a magnification of "1" for the flat portion 416 of the print medium 401 that is indicative of a normal printing process. The magnification for the inclined portion 410 decreases with increasing distance from the flat portion 416. Like the part with the magnification of "0" in FIG. 5 in the first embodiment, the area 609 outside the inclined portion 410 has a magnification of "0" such that no color material is ejected to the area 609.

In a case in which an image is printed on the inclined portion such that paleness of the color gradually increases consistently with distance from the flat portion, print matter can be created in which the print image on the inclined portion is unnoticeable.

Fourth Embodiment

In the first embodiment described above, the magnification for the inclined portion of the print medium is acquired, and based on the magnification, the volume of the color material ejected to the inclined portion is increased. In the present embodiment, a special halftone process is executed on the print image for the inclined portion to suppress deterioration of image quality of the image to be printed on the inclined portion. The present embodiment uses an application and a printing apparatus similar to those in the first embodiment. For simplification of description, only differences from the first embodiment will be described, and elements of the fourth embodiment similar to the corresponding elements of the first embodiment will not be described below.

Processing from step S1 top step S8 in the present embodiment is similar to the processing from step S1 to step S8 in the first embodiment. In a halftone process in step S9, determination is made as to whether or not an inclined portion is present in the print medium to be printed, based on the print medium information. In a case in which no inclined portion is present, a normal halftone process is executed. In a case in which an inclined portion is present, a special halftone process is executed that deals with deviation in a landing position of the color material such as ink (misalignment of the print position). A special halftone process that deals with the deviation in the landing position of the ink is described, for example, in Japanese Patent Laid-Open No. 2014-113819.

The reason for the use of such a special halftone is as follows. As described above, the inclined portion 410 in FIG. 4B needs, for the area proportional to the length L2, a printing process with a resolution for the area proportional to the length L1. The deviation in the landing position of each ink droplet in the inclined portion 410 is equivalent to $\sqrt{2}$-fold of the deviation in the landing position of each ink droplet on the flat portion 416. A distance between the print medium 401 and the print head 201 (sheet distance) increases consistently with the distance from the boundary line 612 toward the outside. In a case in which an ink droplet is ejected from the print head 201 in a slightly oblique direction, a distance from a landing expected position to the actual landing position of the ink droplet increases consistently with the sheet distance regardless of the angle of the inclination. In other words, the deviation in the ink landing position on the print medium with the inclined portion produces more adverse effect than the deviation in the ink landing position on a normal print medium having only a flat portion and no inclined portion. Therefore, the special halftone process that deals with such deviation in the landing position of an ink droplet is executed to allow the image quality of the image to be printed on the inclined portion to be restrained from being deteriorated. This corresponds to print control performed on a print medium with a locally varying height (thickness) according to the height.

Granularity resulting from ink droplets is known to be slightly sacrificed by the special halftone process that deals with the deviation in the landing position of the ink droplet, in other words, a halftone process that resists the deviation in the landing position of the ink droplet. Such a special halftone process may be executed exclusively on an inclined portion with a magnification other than "1" based on the print medium information. Consequently, an image with high granularity can be printed on the flat portion.

In the present example, a determination is made as to whether or not any inclined portion is present in the print medium to be printed, based on the print medium information. The present invention is not, however, limited to this determination. For example, some print media with no inclined portion are expected to have a step resulting in a locally varying height (thickness).

Thus, in step S3, information indicating whether or not the print medium has a locally varying height is acquired as a part of the print medium information. In a case in which, based on this information, the print medium is determined to have a locally varying height, the special halftone process is executed that resists the deviation in the landing position of the ink droplet. The locally varying height means that the distance between the print head and the print medium is locally longer. A longer distance between the print head and the print medium leads to a more significant deviation in the landing position of the ink droplet, and thus, the special halftone process is executed to allow such adverse effects to be suppressed.

In step S3, as a part of the print medium information, information on the height (thickness) of the print medium (height information) is acquired. As is the case with the magnification for each pixel in FIG. 5, height information for each pixel is digitalized. For example, for the height information, the highest position is specified as "1", with the other heights specified as a value smaller than "1". The special halftone process that resists the deviation in the landing position of the ink droplet may be executed exclusively on pixels with a height information value of smaller than "1". Consequently, an image also having high granularity can be printed on the flat portion.

Fifth Embodiment

Figure 11:
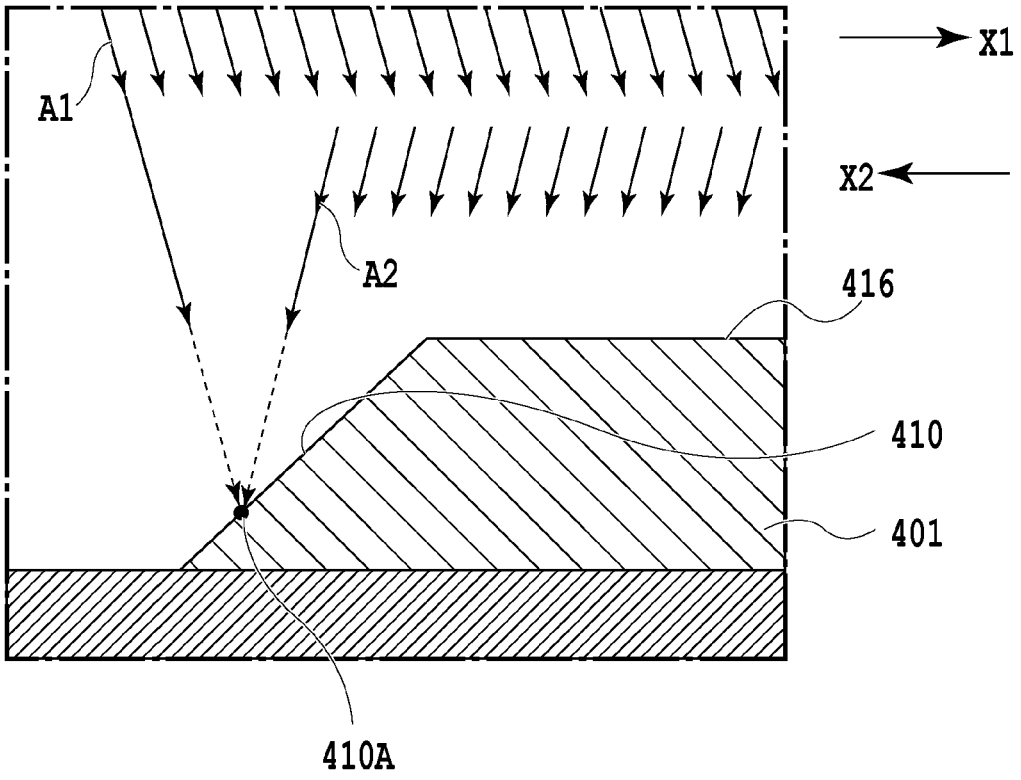
FIG. 11 is a diagram illustrating a printing operation in a variation of a fifth embodiment of the present invention.

In the variation of the second embodiment, an image is printed on the inclined portion 410 of the print medium 401 that is positioned at the edge of the tray 1101 in a case in which the print head moves in the direction of arrow X2. In the present embodiment, as depicted in FIG. 11, an image is printed on the inclined portion 410 of the print medium 401 that is not positioned at the edge of the tray. The present embodiment involves many descriptions common to the second embodiment, and thus, only differences from the variation of the second embodiment will be described.

In the present embodiment, an image is printed on the inclined portion 410 in a case in which the print head moves in the direction of arrow X1. In other words, an image is printed on the inclined portion 410 with the ink ejected in the direction of arrow A1. The ink ejected in the direction of arrow A1 lands on the part 410A on the inclined portion 410 at an angle close to the right angle, in other words, an angle close to the angle at which the ink lands on the flat portion 416. On the other hand, the ink ejected in the direction of arrow A2 in a case in which the print head moves in the direction of arrow X2 lands on the part 410A in a significantly inclined direction. Therefore, preferably, for the inclined portion 410 in FIG. 11, an image is printed in a case in which the print head moves in the direction of arrow X1, whereas, for the inclined portion 410 depicted in the right of FIG. 10B, an image is printed in a case in which the print head moves in the direction of arrow X2.

The user makes settings on the application through the UI so as to allow an image to be printed on a combination of the print medium and the tray. In that case, the application acquires a prepared image in one channel from the relevant file. The image is information (moving direction information) on the moving direction of the carriage corresponding to the moving direction of the print head, and has as many pixels as the image data generated in step 5 in FIG. 3 described above. The moving direction information has a pixel value of "1" in a case in which the print head is instructed to print an image when moving in the direction of arrow X1 and a pixel value of "2" in a case in which the print head is instructed to print an image when moving in the direction of arrow X2. In a case in which printing is possible in both directions of arrows X1, X2, the moving direction information has a pixel value of "0".

As described above, according to a part of the print medium, the direction in which the print head moves to print that part is selected. Specifically, for the part 410A located in the left of FIG. 10B, an image is printed during movement in the direction of arrow X1, whereas, for the part 410B located in the right of FIG. 10B, an image is printed during movement in the direction of arrow X2. Thus, the direction in which the print head moves to print the inclined portion is selected according to the inclination direction of the inclined portion so as to allow the ink to land on the inclined portion at an angle close to the right angle. This makes the ink landing angle on the inclined portion closer to the ink landing angle on the flat portion, allowing the image quality of the image for the inclined portion to be restrained from being deteriorated.

In the present embodiment, a moving speed of the carriage (a scanning speed of the print head) is varied according to the angle of the print surface of the print medium. An increased moving speed of the carriage increases the inclination (with respect to the up-down direction in FIG. 10C) of the ink ejection direction depicted by arrow A1 or A2. Thus, in FIG. 10C, the angle at which the ink ejected in the direction of arrow A1 lands on the print surface of the inclined portion 410 is closer to the right angle. The volume of ink ejected by a single pass (scan) of the print head decreases by an amount equal to an increase in the moving speed of the carriage. An increased number of passes of the print head, however, provides an adequate volume of ink ejected to the predetermined print area. As described above, the moving speed of the carriage is varied to allow the ink to land on the inclined portion of the print medium at an angle close to the right angle with respect to the print surface of the inclined portion. Thus, a high-quality image can be printed.

Other Embodiments

In the above-described embodiments, the processes in steps S1 to S5 are executed by the application in the information processing apparatus, and the processes in step S6 and the subsequent steps are executed by the printing apparatus. The present invention is not, however, limited to this arrangement. All the steps may be executed by the printing apparatus including the UI or all the steps other than step S10 may be executed by the information processing apparatus.

The present invention is not only applicable to serial-scan ink jet printing apparatuses but also widely applicable to printing apparatuses based on various methods, for example, a full line method. The present invention is applicable not only to printing apparatuses that print multi-color images with inks in a plurality of colors but also to printing apparatuses that print monochrome images. A tray holding the print medium may be used to allow what is called marginless printing to be executed on the print medium. The marginless printing is a method for printing an image so as to avoid forming a margin in at least a part of the edge of the print medium.

The above-described embodiments are only examples for producing the effects the present invention. Other similar techniques and different parameters are included within the scope of the present invention in a case in which effects similar to those of the present invention are produced using the techniques or the parameters. The present invention is also applicable to a system including a plurality of pieces of equipment (for example, a host computer, interface equipment, a reader (reading apparatus), and a printer (printing apparatus)). The present invention is also applicable to an apparatus that is one piece of equipment (for example, a printer (printing apparatus), a copier, or a facsimile machine).

The object of the present invention can be accomplished by the following configuration. That is, a storage medium (or a recording medium) is prepared in which software program codes that implement the functions of the above-described embodiments are stored. The storage medium is supplied to a system or an apparatus. Then, a computer (or a CPU or an MPU) in the system or the apparatus reads and executes the program codes stored in the storage medium. In this case, the program codes read from the storage medium implement the functions of the above-described embodiments. The storage medium storing the program codes forms the present invention. The functions of the above-described embodiments may be implemented by any method other than execution of the read program codes by the computer. For example, an operating system (OS) that operates on the computer may execute a part or all of the actual processing based on the indication of the program codes so that the processing allows the functions of the above-described embodiments to be implemented. Such a configuration is also included in the present invention.

The object of the present invention can be accomplished by the following configuration. That is, the program codes read from the storage medium are written to a memory provided in an expansion card inserted into the computer or in an expansion component connected to the computer. Subsequently, based on instructions in the program codes, for example, a CPU provided in the expansion card or the expansion component executes a part or all of the actual processing so that the processing allows the functions of the above-described embodiments to be implemented. Such a configuration is also included in the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

I claim:

1. A control apparatus for a printing apparatus that prints an image by applying ink to a print surface using a print head, the control apparatus comprising:

an acquisition unit configured to acquire information on an inclination of the print surface of a print medium placed on a support surface that supports the print medium, the print medium having a locally varying thickness, the print surface being inclined relative to the support surface; and a control unit configured to control, based on the information acquired by the acquisition unit, printing according to a print condition corresponding to a magnitude of the inclination, wherein the print head prints an image on the print medium held in a tray.

2. The control apparatus according to claim 1, wherein the control unit controls, based on the information, a volume of ink applied per unit area of the print surface according to the magnitude of the inclination.

3. The control apparatus according to claim 1, wherein the print surface includes a first surface portion and a second surface portion having the inclination greater than the inclination of the first surface portion, and wherein the control unit control sets a volume of ink applied per unit area of the second surface portion greater than a volume of ink applied per unit area of the first surface portion.

4. The control apparatus according to claim 1, wherein the print head is configured to print a multi-color image using inks in a plurality of colors, and wherein the control unit controls a volume of at least one of the inks in the plurality of colors applied per unit area according to the magnitude of the inclination.

5. The control apparatus according to claim 1, wherein the print surface includes a first surface portion and a second surface portion having the inclination greater than the inclination of the first surface portion, and wherein the control unit sets a print speed for the second surface portion that is less than a print speed for the first surface portion.

6. The control apparatus according to claim 1, wherein the print head enables a forward printing in which the print head prints an image while moving in a forward direction and a backward printing in which the print head prints an image while moving in a backward direction, and wherein the control unit selects the forward printing or the backward printing depending on a direction of the inclination of the print surface.

7. The control apparatus according to claim 1, wherein the print head prints an image through a plurality of scans of a predetermined area of the print surface, wherein the print surface includes a first surface portion and a second surface portion having the inclination greater than the inclination of the first surface portion, and wherein the control unit sets a number of scans of the second surface portion by the print head to be greater than a number of scans of the first surface portion by the print head.

8. The control apparatus according to claim 1, wherein the print head applies ink based on image data, and wherein the control unit corrects the image data based on the information.

9. The control apparatus according to claim 8, wherein the control unit varies a halftone process to be executed based on the information.

10. The control apparatus according to claim 8, wherein the control unit processes the image data at a varying resolution based on the information.

11. The control apparatus according to claim 1, wherein the printing apparatus comprises the print head.

12. A control apparatus for a printing apparatus that prints an image by applying ink to a print surface of a print medium using a print head, the control apparatus comprising:

an acquisition unit configured to acquire information on a height of the print medium placed on a support surface that supports the print medium, the print medium having a locally varying height from the support surface; and a control unit configured to control, based on the information acquired by the acquisition unit, printing according to a print condition corresponding to the height.

13. The control apparatus according to claim 12, wherein the control unit controls, based on the information, a volume of ink applied per unit area of the print surface according to the height.

14. The control apparatus according to claim 12, wherein the print surface includes a first surface portion and a second surface portion having the height less than the height of the first surface portion, and wherein the control unit control sets a volume of ink applied per unit area of the second surface portion to be greater than a volume of ink applied per unit area of the first surface portion.

15. The control apparatus according to claim 12, wherein the print head is configured to print a multi-color image using inks in a plurality of colors, and wherein the control unit controls a volume of at least one of the inks in the plurality of colors applied a per unit area according to the height.

16. A printing method for printing an image by applying ink to a print surface using a print head, the printing method comprising:

an acquisition step of acquiring information on an inclination of the print surface of a print medium placed on a support surface that supports the print medium, the print medium having a locally varying thickness, the print surface being inclined relative to the support surface; and a printing step of performing printing according to a print condition corresponding to a magnitude of the inclination, wherein the print head prints an image on the print medium held in a tray.

17. A storage medium in which is stored a program code configured to execute the printing method according to claim 16.

* * * * *